US009920892B2

(12) United States Patent
Yurich

(10) Patent No.: US 9,920,892 B2
(45) Date of Patent: Mar. 20, 2018

(54) MODULAR LED SYSTEM FOR A LIGHTING ASSEMBLY

(71) Applicant: Gary D. Yurich, Royal Oak, MI (US)

(72) Inventor: Gary D. Yurich, Royal Oak, MI (US)

( * ) Notice: Subject to any disclaimer, the term of this patent is extended or adjusted under 35 U.S.C. 154(b) by 14 days.

(21) Appl. No.: 15/043,099

(22) Filed: Feb. 12, 2016

(65) Prior Publication Data

US 2017/0234494 A1 Aug. 17, 2017

(51) Int. Cl.

| | |
|---|---|
| ***F21V 7/00*** | (2006.01) |
| ***F21S 2/00*** | (2016.01) |
| ***F21V 23/00*** | (2015.01) |
| ***F21V 23/04*** | (2006.01) |
| ***F21V 29/67*** | (2015.01) |
| ***F21V 29/83*** | (2015.01) |
| ***F21V 29/75*** | (2015.01) |
| ***F21V 7/04*** | (2006.01) |
| ***F21S 8/06*** | (2006.01) |
| ***F21V 23/02*** | (2006.01) |
| ***F21V 23/06*** | (2006.01) |
| ***F21V 17/12*** | (2006.01) |
| *F21Y 115/00* | (2016.01) |

(52) U.S. Cl.

CPC ..... *F21S 2/005* (2013.01); *F21S 8/063* (2013.01); *F21V 7/0008* (2013.01); *F21V 7/0083* (2013.01); *F21V 7/04* (2013.01); *F21V 17/12* (2013.01); *F21V 23/003* (2013.01); *F21V 23/02* (2013.01); *F21V 23/0457* (2013.01); *F21V 23/06* (2013.01); *F21V 29/673* (2015.01); *F21V 29/75* (2015.01); *F21V 29/83* (2015.01); *F21Y 2115/00* (2016.08)

(58) Field of Classification Search

CPC ..... F21Y 2107/30; F21Y 2107/40; F21Y 2115/00; F21V 29/74; F21V 29/75; F21V 23/003; F21V 23/0457; F21V 23/02; F21V 23/03; F21V 23/06; F21V 29/673; F21V 29/83; F21V 7/04; F21V 7/0083; F21V 7/0008; F21V 17/12; F21K 9/00; F21S 2/005; F21S 8/063

USPC ..... 362/235

See application file for complete search history.

(56) References Cited

U.S. PATENT DOCUMENTS

| | | | | |
|---|---|---|---|---|
| 4,830,182 | A | 5/1989 | Nakazato et al. | |
| 5,586,004 | A | 12/1996 | Green et al. | |
| 6,382,803 | B1 * | 5/2002 | Arumugasaamy | F21V 7/09 359/850 |
| 7,048,412 | B2 | 5/2006 | Martin et al. | |
| 7,144,135 | B2 | 12/2006 | Martin et al. | |
| 7,207,695 | B2 | 4/2007 | Coushaine et al. | |

(Continued)

*Primary Examiner* — Claude J Brown

(74) *Attorney, Agent, or Firm* — Howard & Howard Attorneys PLLC

(57) ABSTRACT

One non-limiting example of an LED system for a lighting assembly includes a heat sink having a plurality of base plates. Each of the base plates has a pair of opposing edges disposed adjacent to a corresponding one of the other base plates. Additionally, each base plate has an outer face extending between the opposing edges; and the LED system further includes a plurality of LEDs attached to the outer face of each base plate. A fan is releasably attached to a bottom portion of the heat sink and configured to produce a flow of air through the heat sink from the bottom portion through a top portion of the heat sink to maintain an operating temperature of the LED system.

6 Claims, 19 Drawing Sheets

(56) References Cited

U.S. PATENT DOCUMENTS 7,314,291 B2 1/2008 Tain et al.
7,534,015 B2 5/2009 Xu et al.
7,593,229 B2 9/2009 Shuy
7,641,361 B2 1/2010 Wedell et al.
7,748,876 B2 7/2010 Zhang et al.
8,123,378 B1 * 2/2012 Ruberg ..... F21S 8/088 362/249.02
8,123,382 B2 2/2012 Patrick et al.
8,143,769 B2 3/2012 Li
8,167,468 B1 * 5/2012 Olsson ..... F21S 8/03 362/101
8,197,091 B1 * 6/2012 Kyle ..... F21V 29/004 362/249.06
8,206,009 B2 6/2012 Tickner et al.
8,641,239 B2 2/2014 Yurich
8,680,754 B2 3/2014 Premysler
8,696,163 B2 * 4/2014 Chen ..... F21V 29/02 362/255
8,696,169 B2 4/2014 Tickner et al.
9,115,876 B1 * 8/2015 Mart ..... F21V 23/005
9,523,494 B2 * 12/2016 Hayes ..... F21V 29/773
2006/0193139 A1 * 8/2006 Sun ..... F21K 9/233 362/373
2007/0230184 A1 * 10/2007 Shuy ..... F21K 9/00 362/294
2008/0316755 A1 12/2008 Zheng et al.
2009/0040750 A1 * 2/2009 Myer ..... F21S 8/083 362/183
2009/0052175 A1 * 2/2009 Xu ..... F21K 9/00 362/249.01
2009/0153061 A1 * 6/2009 Cho ..... H01J 61/52 315/117
2009/0303717 A1 * 12/2009 Long ..... F21K 9/00 362/249.02
2010/0002453 A1 * 1/2010 Wu ..... F21V 3/00 362/373
2010/0091507 A1 4/2010 Li et al.
2010/0097794 A1 * 4/2010 Teng ..... F21V 7/09 362/231
2010/0264800 A1 * 10/2010 Liu ..... F21V 29/51 313/46
2010/0314985 A1 * 12/2010 Premysler ..... F21V 29/402 313/46
2011/0089830 A1 4/2011 Pickard et al.
2011/0090686 A1 4/2011 Pickard
2011/0285267 A1 * 11/2011 Lu ..... F21K 9/00 313/46
2012/0188745 A1 * 7/2012 Yoneda ..... F21V 29/02 362/84
2012/0230026 A1 9/2012 Li et al.
2012/0268936 A1 * 10/2012 Pickard ..... F21K 9/90 362/249.02
2013/0301252 A1 * 11/2013 Hussell ..... F21V 29/004 362/184
2013/0301275 A1 11/2013 Kim
2014/0293603 A1 * 10/2014 Barnard ..... F21V 29/74 362/241
2014/0354155 A1 * 12/2014 Clifford ..... F21V 29/02 315/113
2015/0109758 A1 * 4/2015 Allen ..... F21V 3/0463 362/84
2015/0354804 A1 * 12/2015 Mirabelli ..... F21V 33/0052 362/363
2016/0123571 A1 * 5/2016 Chan ..... F21V 29/83 362/249.01

* cited by examiner

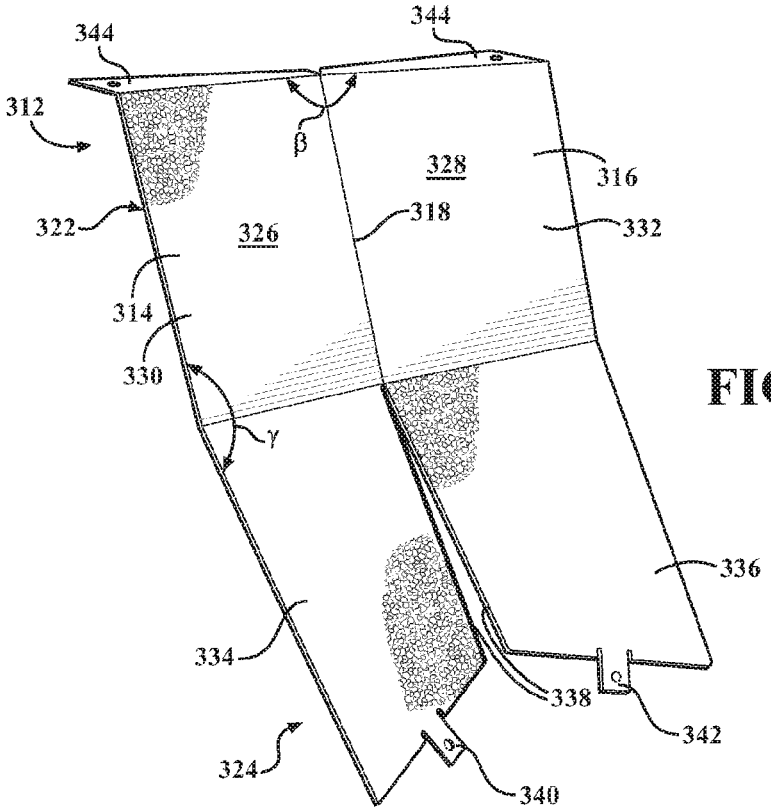
FIG. 18
FIG. 20
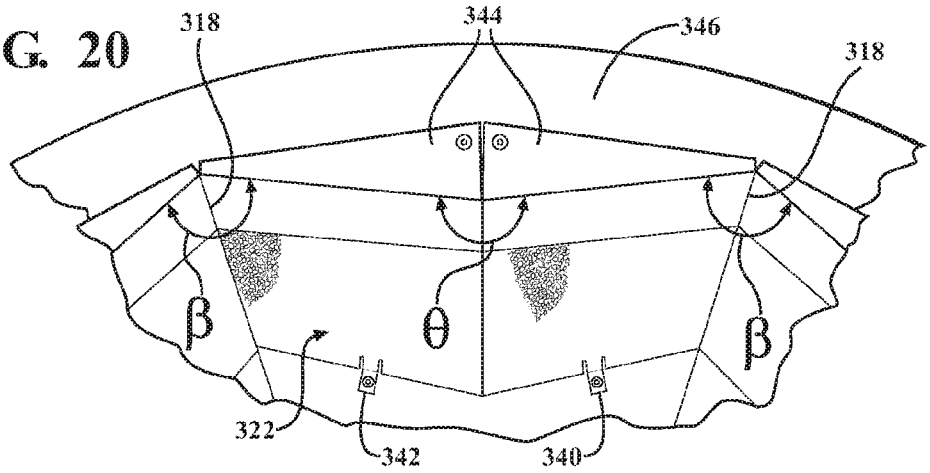

MODULAR LED SYSTEM FOR A LIGHTING ASSEMBLY

TECHNICAL FIELD

The present invention generally relates to a light emitting diode ("LED") system, and more specifically, a lighting assembly that includes the LED system and a reflector body for uniformly and efficiently dispersing light emitted by the LED system for commercial and industrial facilities having large floor spaces that require adequate light, such as indoor sports facilities, fieldhouses, manufacturing plants, warehouses, airports, convention centers, or other various indoor applications.

BACKGROUND OF THE DISCLOSURE

Light fixture manufacturers continuously develop lighting assemblies having LED systems in view of the various benefits provided by LEDs, as compared to traditional light sources. Examples of these benefits can include a longer service life, higher energy efficiency, full dimmability and instant lighting. These benefits can provide considerable value in facilities having large floor spaces that require light in multiple directions. However, it is particularly difficult to achieve adequate lighting of large floor spaces due to the height of the light fixtures relative to the area to be lit and the width of the area to be lit relative to the number of light fixtures. In one type of application, such as indirect lighting, the light fixture reflects light off a ceiling or structure above the light fixture. The LED systems can create hot spots or glare when viewed from below, making the lighting inadequate.

In an attempt to uniformly reflect light emitted by the LEDs and dissipate heat generated by the same, some existing lighting assemblies utilize complex components, optics and circuitry to achieve these goals. However, these lighting assemblies can have a high overall weight, and be somewhat difficult and expensive to manufacture. In one such example, the LEDs are mounted in a horizontal position to a rectangularly shaped heat sink and the light is directed upwards toward the structure above the LED such that the light is emitted without a reflector. One disadvantage is that dust and other impediments can sit on the LEDs making it necessary to service the fixture to maintain the same light output. Further, the heat sink is large and heavy making it more difficult to install and inapplicable to some applications, such as dome structures. Typically, such horizontal LEDs can weigh upwards of 60 pounds due to the heat sink. Other lighting assemblies may have dome-shaped reflectors and LEDs disposed within a hole defined at an apex of the reflective dome. However, these assemblies are typically for smaller light output applications and do not generate large amounts of heat or may not efficiently dissipate heat generated by the LEDs. These assemblies also do not uniformly distribute light because much of the light can exit the lighting assembly directly without being reflected and scattered by the reflector.

SUMMARY OF THE DISCLOSURE

One non-limiting example of an LED system includes a heat sink having a plurality of base plates. Each base plate can include a pair of opposing edges and an outer face extending between the opposing edges. Additionally, the LED system includes a plurality of LED boards, which are coupled to the outer face. Each LED board has a plurality of LEDs and is spaced apart from the opposing edges by at least one inch.

A non-limiting example of a lighting assembly for illuminating an area includes a reflector body surrounding an opening. The lighting assembly can further include an LED system, which has a heat sink and a plurality of LED boards. The heat sink includes a plurality of base plates. Each base plate includes a pair of opposing edges, an outer face extending between the opposing edges, and an inner face. The LED boards are coupled to the outer face of a corresponding one of the base plates, respectively. Each LED board includes a plurality of LEDs and is spaced apart from each of the opposing edges. Additionally, the heat sink further includes a plurality of fins extending from the inner face. These fins provide a peak profile decreasing from a middle portion of the corresponding base plate laterally outward to the opposing ends. Each base plate has a predetermined width, as measured in a direction extending perpendicularly from one of the opposing edges to the other of the opposing edges. The height profile includes a maximum height extending perpendicularly from the middle portion of the corresponding base plate. A ratio of the predetermined width to the maximum height is at least 3:1.

BRIEF DESCRIPTION OF THE DRAWINGS

Referring now to the drawings, exemplary illustrations are shown in detail. Although the drawings represent representative examples, the drawings are not necessarily to scale and certain features may be exaggerated to better illustrate and explain an innovative aspect of an illustrative example. Further, the exemplary illustrations described herein are not intended to be exhaustive or otherwise limiting or restricting to the precise form and configuration shown in the drawings and disclosed in the following detailed description. Exemplary illustrations are described in detail by referring to the drawings as follows:

FIG. 18 is a perspective view of one of the second reflectors of FIG. 16.

FIG. 20 is an enlarged view of an upper portion of the reflector body of FIG. 14.

DETAILED DESCRIPTION OF THE DISCLOSURE

The subject invention relates to an exemplary modular light emitting diode ("LED") system for a lighting assembly that includes a plurality of LEDs and a heat sink configured to efficiently dissipate heat produced by the LEDs while having a simple and lightweight construction.

Figure 1:
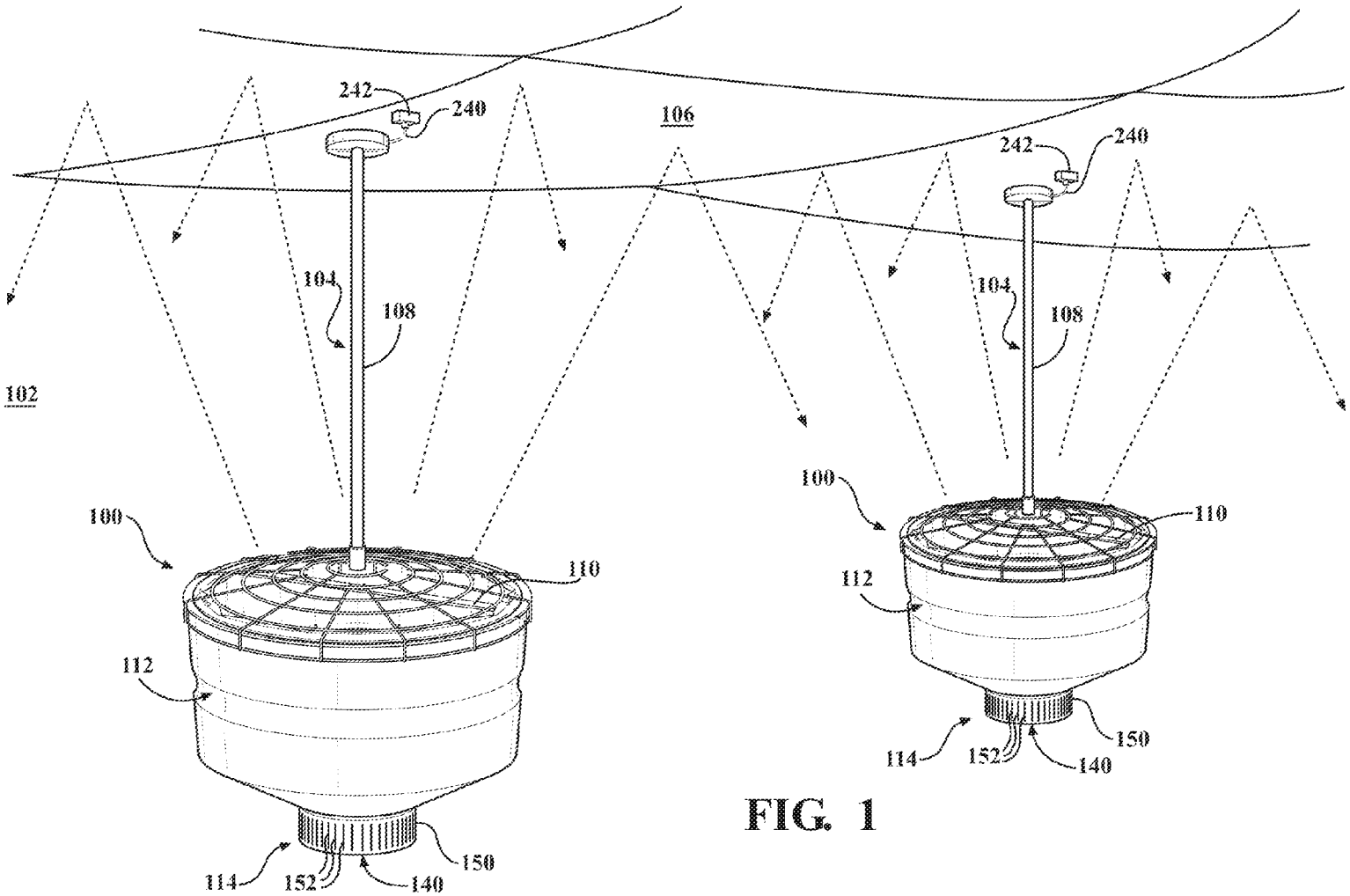
FIG. 1 is an environmental view of two exemplary lighting assemblies, suspended from a ceiling for an indirect lighting application.

Referring to FIG. 1, two exemplary indirect lighting assemblies 100 are configured to uniformly distribute light in multiple directions, so as to illuminate a surrounding environment 102. Exemplary environments include an indoor sports facility, a manufacturing plant, a fieldhouse, a warehouse, an airport, a convention center, various indoor facilities having large floor spaces with ceilings from 16 feet to 100 feet in height, or any other suitable environment that requires adequate light to conduct an activity. While FIG. 1 illustrates two lighting assemblies 100, more or fewer lighting assemblies 100 may be used according the lighting requirements of the environment 102. In this example, the lighting assemblies are identical to one another and, thus, the following description may be directed to both of the assemblies.

Referring still to FIG. 1, each one of the lighting assemblies 100 may include an attachment mechanism 104 configured to attach the corresponding lighting assembly 100 to a ceiling 106. In one non-limiting example, the attachment mechanism 104 can include a pendant mount 108, which has one end attached to a support mechanism (not shown) coupled to the ceiling 106 and further includes an internal channel (not shown) for passing electrical wiring therethrough. The attachment mechanism 104 can also have a crossbar 110, which is attached to an opposing end of the pendant mount 108 and disposed perpendicularly to the same. However, the attachment mechanism can instead include more than one pendant mount 108 or include a cable mounting mechanism that uses multiple cables that are secured to the ceiling. Of course, any suitable method of coupling the lighting assembly 100 to the ceiling 106 can be used.

Figure 2A:
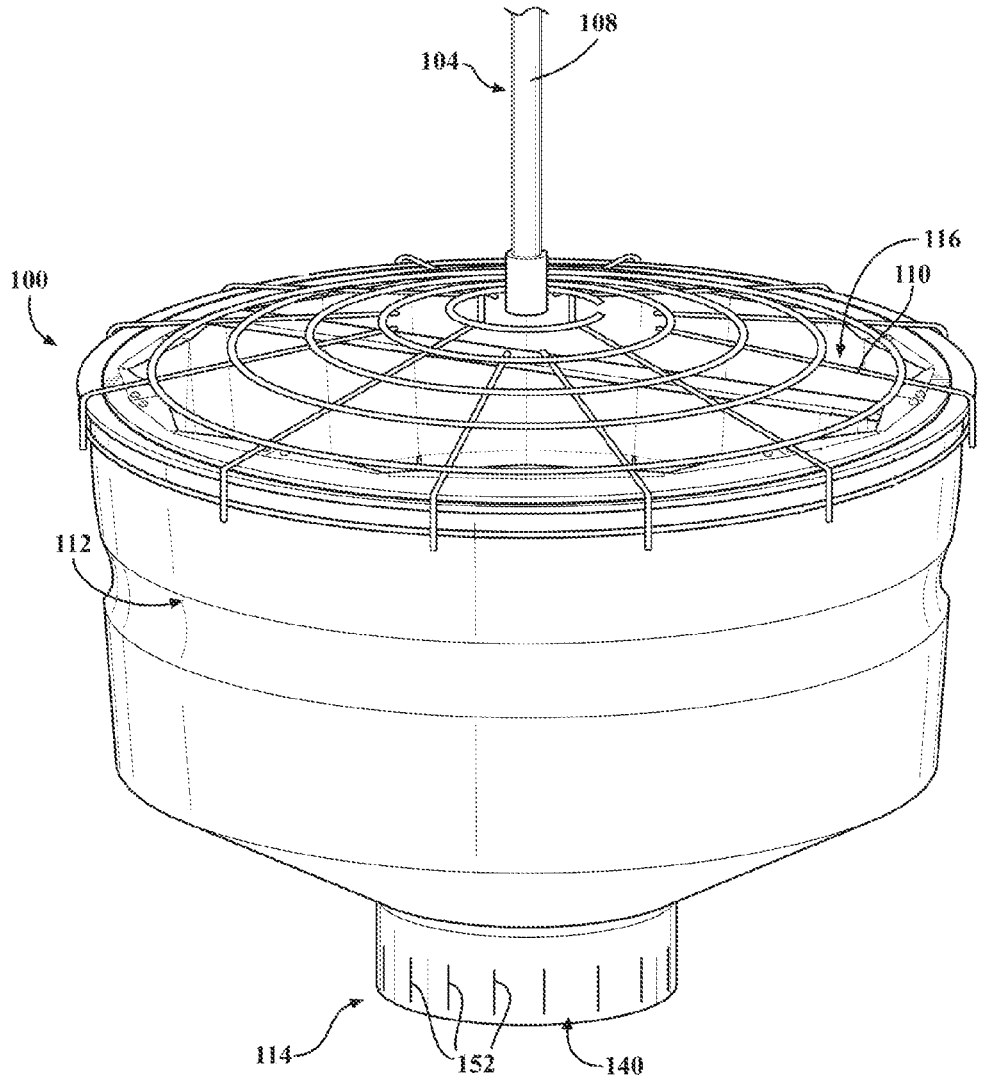
FIG. 2A is a perspective view of one of the lighting assemblies of FIG. 1.

As shown in FIG. 1, the exemplary lighting assembly 100 operates as an indirect-light assembly, such that the lighting assembly 100 is configured to emit light onto the ceiling 106, which in turn reflects light to an area below the lighting assembly 100. For illustrative purposes, light rays are shown with dashed lines in FIG. 1. FIG. 2A shows an enlarged view of the indirect mount light assembly 100 of FIG. 1, which can be used with the subject invention to emit light onto an area below by reflecting the light off the ceiling 106.

Figure 2B:
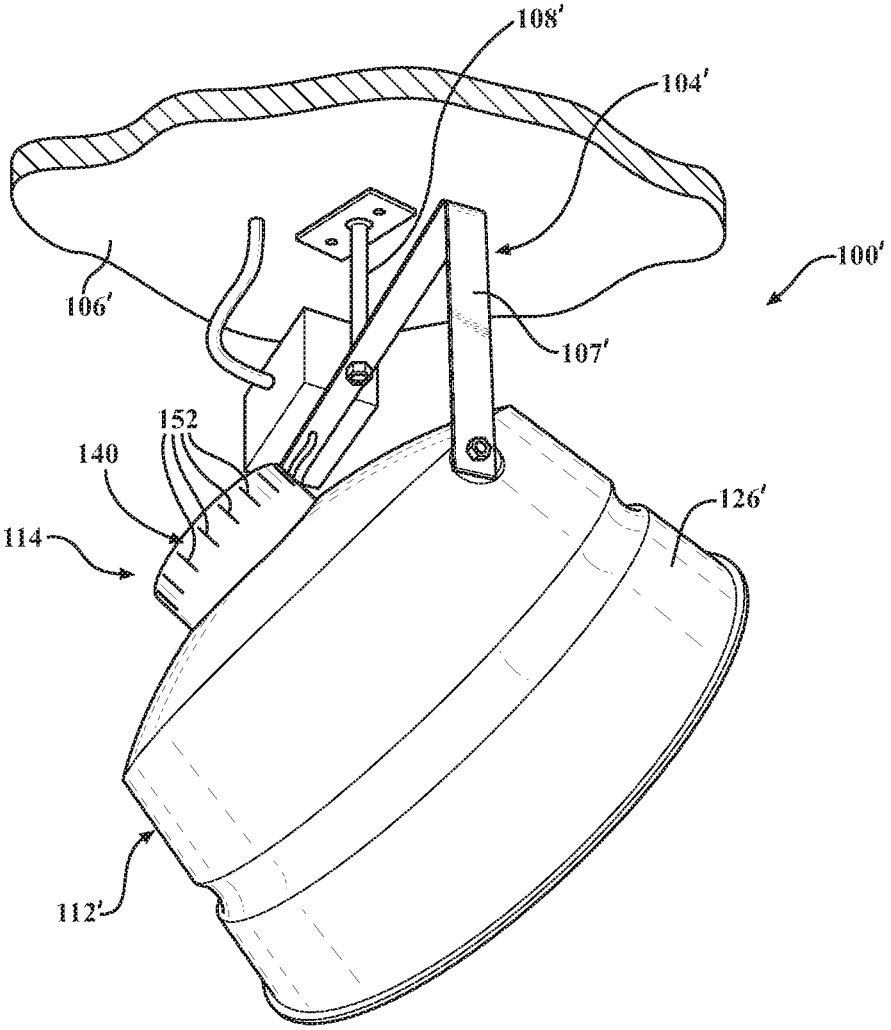
FIG. 2B is a perspective view of a lighting assembly of another embodiment having a pole mount capable of being used in a direct or an indirect lighting application.
Figure 2C:
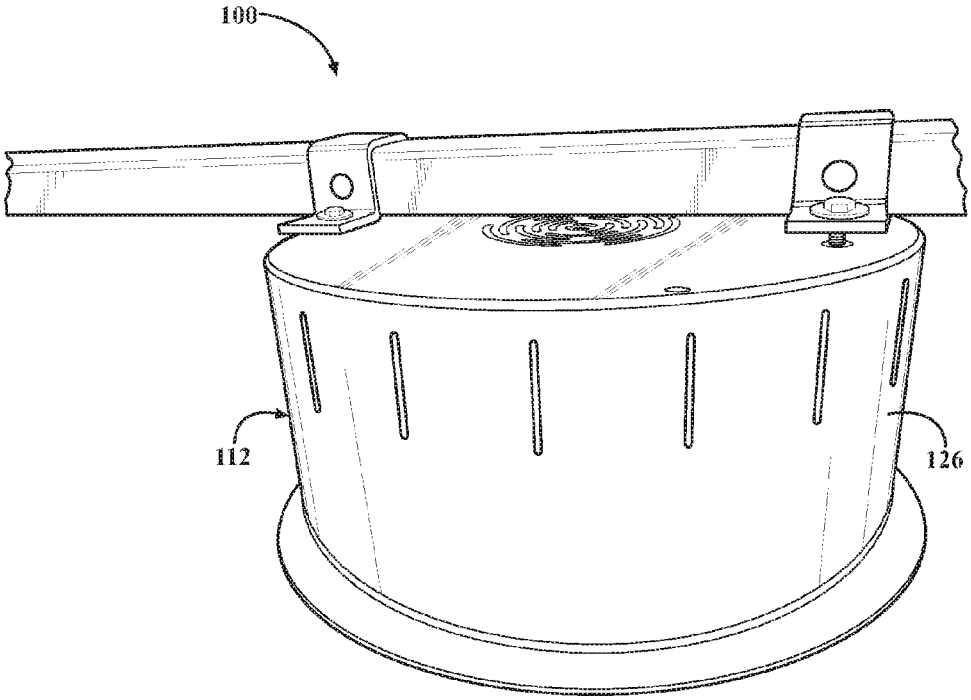
FIG. 2C is a perspective view of a lighting assembly having a strut mount.

FIG. 2B shows another light assembly 100' that can be used with the subject invention to emit light directly or indirectly onto an area below with or without reflecting the light off the ceiling 106. With attention to FIG. 2B, the lighting assembly 100' may also include the attachment mechanism 104' configured to allow the housing 112' to move in various directions. Specifically, the attachment mechanism 104' includes a generally U-shaped portion 107' which couples to the continuous side wall 126'. The housing 112' is pivotably coupled to the attachment mechanism 104' such that the housing 112' may pivot within the U-shaped portion 107' between various angles relative to the attachment mechanism 104' for positioning the lighting assembly 100'. The attachment mechanism 104' further includes a pole or wall mount 108' disposed between the U-shaped portion and the ceiling 106' for coupling the lighting assembly 100' to the ceiling 106', the wall, or other structure. The housing 112' can pivot, both up and down and left and right, to allow for additional positioning of the lighting assembly 100'. FIG. 2C is a perspective view of another lighting assembly having a strut mount for Unistrut applications. It is to be appreciated that different mountings can be used without deviating from the scope of the subject invention.

Figure 3:
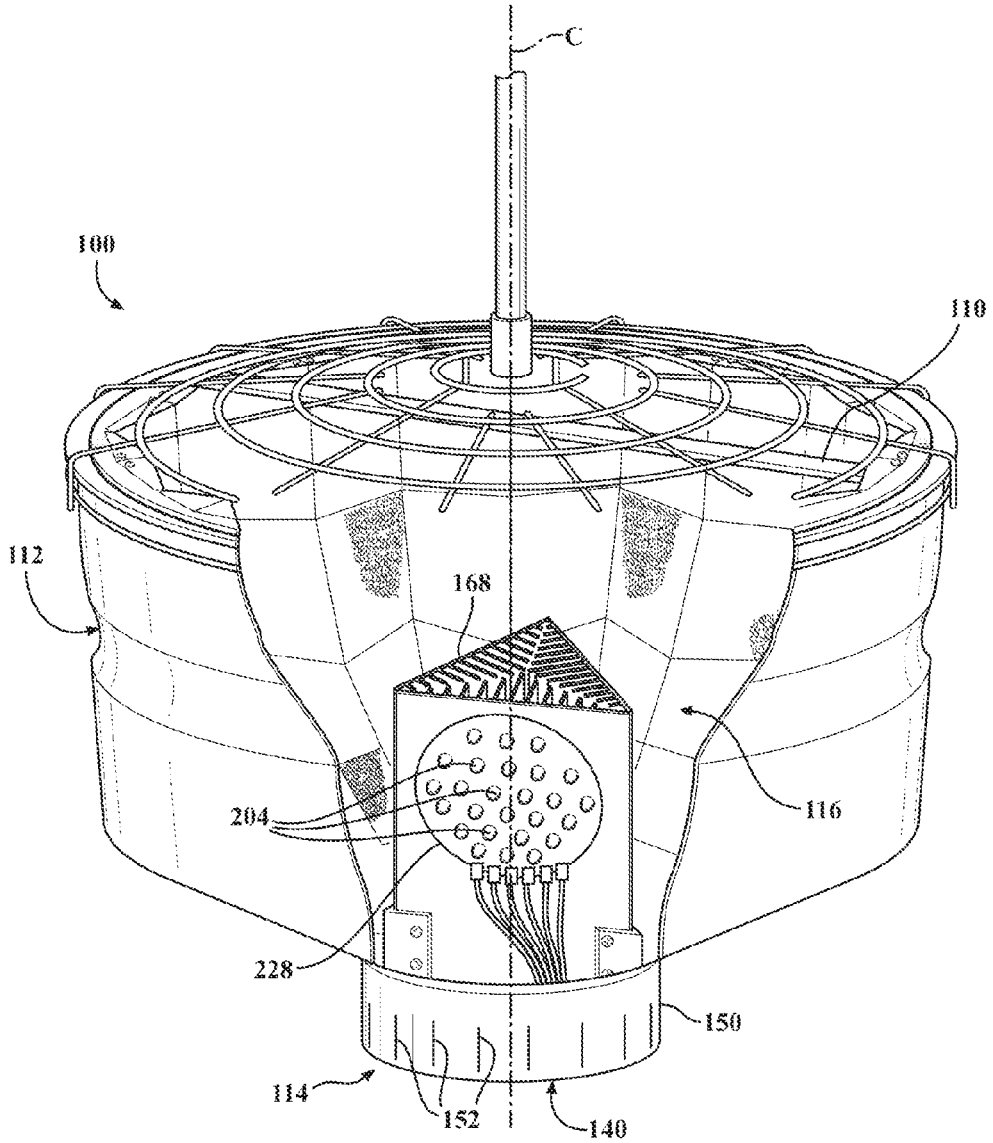
FIG. 3 is a partially cutaway view of the lighting assembly of FIG. 2A, showing the lighting assembly having one example of a LED system.
Figure 4:
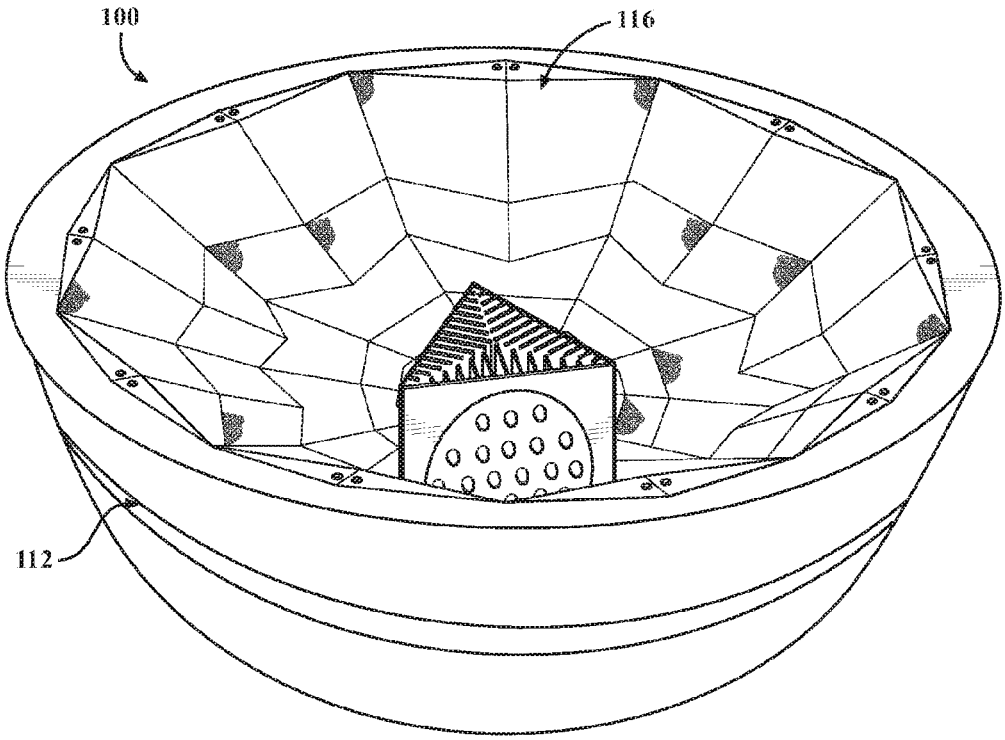
FIG. 4 is a perspective view of the lighting assembly of the subject invention, showing the attachment mechanism and the wire screen removed.
Figure 5:
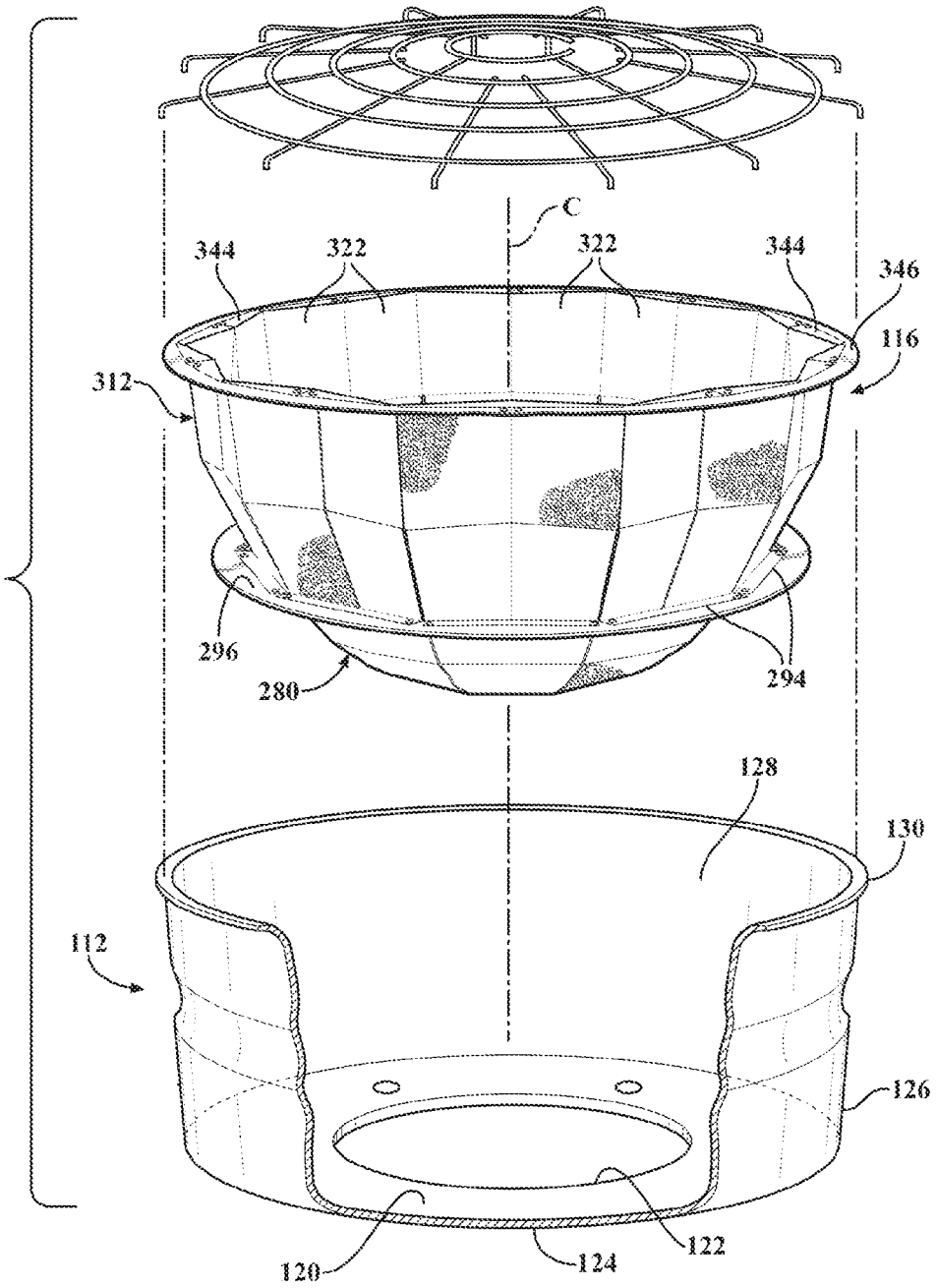
FIG. 5 is an exploded view of the lighting assembly without the LED system to better illustrate the reflector body and the housing, with a partially cutaway view of the housing.

Referring to FIGS. 3 through 5, the lighting assembly 100 generally includes a housing 112. As best shown in FIGS. 3 and 4, a modular LED system 114 and a reflector body 116 are shown in the assembly 100. FIG. 3 illustrates an exploded view of the lighting assembly, without the LED system to better illustrate the housing 112. As best shown in FIG. 5, the housing 112 includes a bottom wall 120 that defines a center hole 122 and an outer periphery 124. The housing 112 can further include an annular sidewall 126, which extends from the outer periphery 124 of the bottom wall 120 and defines a cavity 128 therein. The sidewall 126 can terminate at a rim 130, and the rim 130 can engage the crossbar 110 (FIG. 1), so as to attach the housing 112 to the attachment mechanism 104. However, other portions of the housing 112 or the lighting assembly 100 can be coupled to the attachment mechanism 104 for attaching the lighting assembly 100 to the ceiling. In another example, no portion of the housing 112 may be coupled to an attachment mechanism 104 when, for example, the lighting assembly 100 is not mounted to the ceiling 106.

The housing 112 may be integrally formed as a one-piece body by die casting, stamping, extrusion or other suitable manufacturing processes. However, the housing can instead have any number of parts and be produced by any suitable manufacturing process.

Figure 6A:
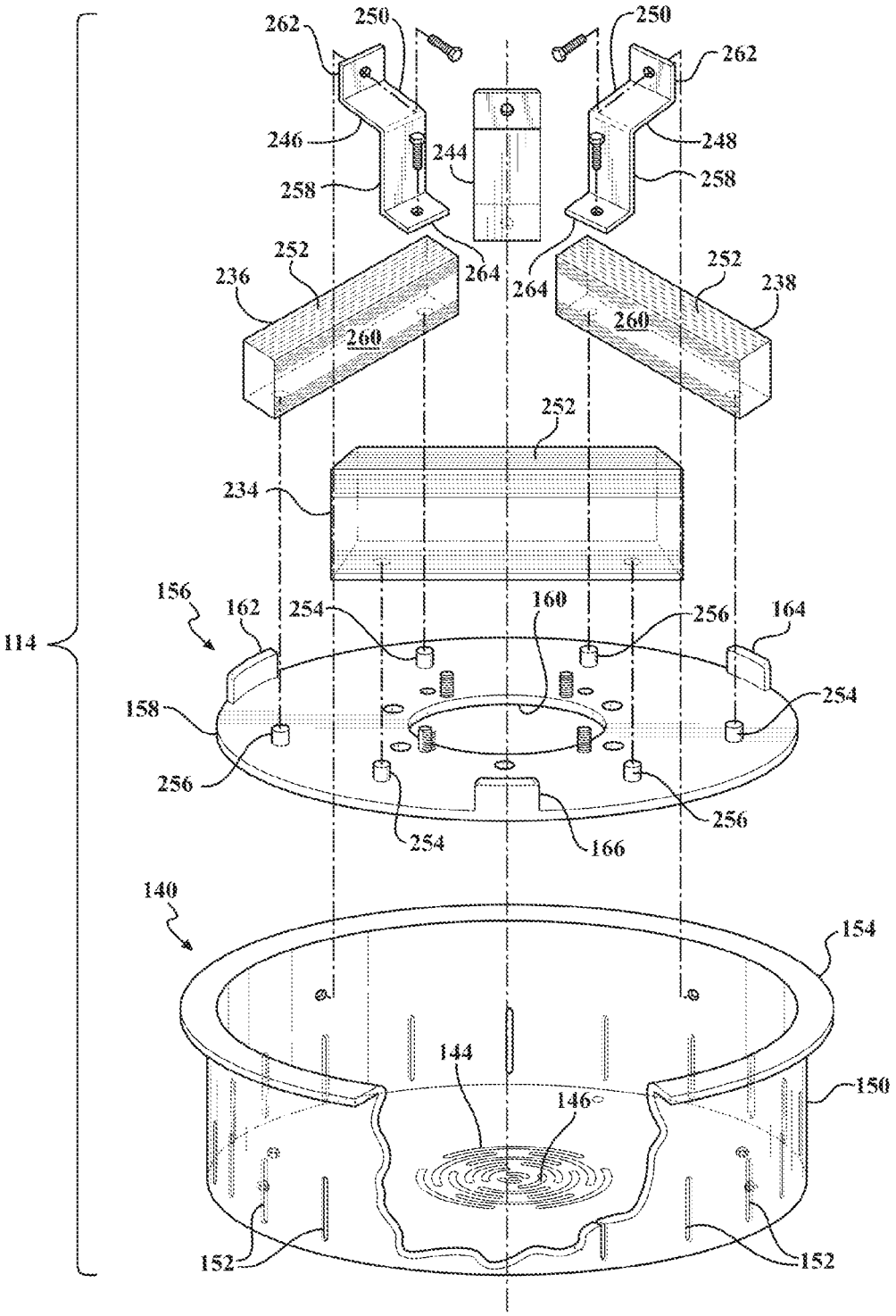
FIG. 6A is an exploded view of a lower portion of the LED system illustrating the LED system having an LED housing, a mounting plate and a series of LED drivers.
Figure 6B:
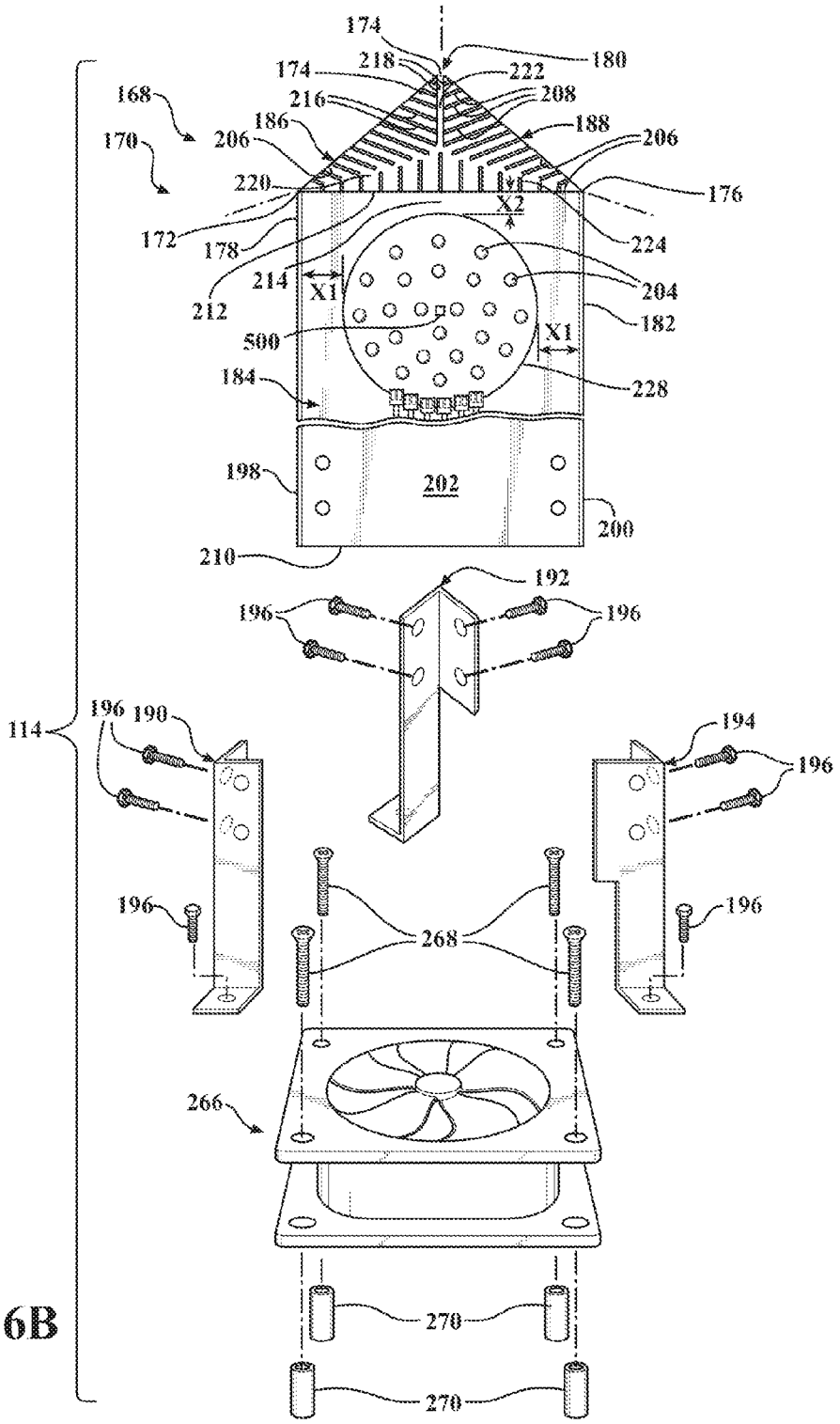
FIG. 6B is an exploded view of an upper portion of the LED system of FIG. 6A illustrating the LED system further including a cooling device such as a fan, a heat sink and series of LEDs.

FIGS. 6A and 6B are enlarged exploded views of corresponding portions the LED system 114. In this example, the reflector body 116 is received within the cavity 128 of the housing 112, and at least a portion of the LED system 114 is disposed within the reflector body 116.

Referring to FIG. 6A, the bottom portion of the LED system 114 can include a LED cap 140 configured to contain or hold at least a portion of the components of the LED system 114. In particular, the cap 140 includes a bottom 144 with apertures 146 and an annular sidewall 150 extending from the bottom 144, and the sidewall 150 includes a grill or series of vents 152 circumferentially spaced apart from one another. The vents 152 are configured to pass a flow of air therethrough, which removes heat from the LED system 114. Of course, the LED cap 140 can have one or more openings disposed in various suitable configurations to pass a flow of air through the lighting assembly.

The sidewall 150 terminates at an end with a flange 154 extending radially outward therefrom. The flange 154 is configured to support the cap 140 on a portion of the bottom wall 120 (FIG. 5) adjacent to the center hole 122 of the housing 112. This flange 154 may be attached to the bottom wall 120 by one or more threaded fasteners, resilient clips, adhesives or other suitable fasteners to permit access to individual components of the LED system 114 for repairing or replacing any damaged components. However, the flange 154 can be supported by the bottom wall 120 without any fasteners attaching the cap 140 to the housing 112. Furthermore, it is contemplated that the cap 140 can be an integral portion of the bottom wall 120 of the housing 112. In still another example, the LED system 114 may not have the cap 140, thus placing other components of the LED system 114 entirely within the cavity 128 of the housing 112 or within a separate body external to the housing 112.

As shown in FIG. 6A, the LED system 114 further includes a mounting plate 156, which is configured to be received within the cap 140 and support multiple modular components of the LED system 114 therein. In one example, various components of the LED system 114 are releasably attached to the mounting plate 156, so as to provide a modular construction that permits one or more damaged components to be easily removed, inspected, repaired or replaced. Examples of releasable fasteners can include threaded fasteners, resilient clips, tongue-in-groove fasteners, hook and loop fasteners, adhesives and other suitable releasable fasteners. However, it is contemplated that any suitable fastening method can be used to attach other components of the LED system 114 to the mounting plate 156.

The mounting plate 156 can be a disc 158 that defines a center hole 160. The disc 158 can have one or more protrusions 162, 164, 166 configured to be attached to the sidewall 150 of the cap 140 by any suitable fasteners. The protrusions 162, 164, 166 may be configured to align the center hole 160 with the apertures 146 of the cap 140, thus facilitating with an unobstructed flow of air into the lighting assembly 100.

Referring to FIG. 6B, the LED system 114 further includes a heat sink 168 for attaching to the mounting plate 156. This exemplary heat sink 168 includes three base plates 184, 186, 188 spaced from one another and attached to the mounting plate 156 by a series of brackets 190, 192, 194 and threaded fasteners 196. However, the heat sink 168 may include multiple base plates 184, 186, 188 depending upon the specific lighting application. Each one of the base plates 184, 186, 188 has a pair of opposing edges 198, 200 extending between a top portion 212 of the heat sink 168 and a bottom portion 210 of the heat sink 168. In addition, the opposing edges 198, 200 are disposed adjacent to corresponding edges of other base plates 184, 186, 188, and each one of the base plates 184, 186, 188 has an outer face 202. The outer face 202 may be a rectangular surface area extending between the opposing edges 198, 200, and the top and bottom portions 212, 210 of the base plates 184, 186, 188. In the example shown, but in no way limiting, the heat sink 168 has a generally triangular prism shaped body 170 and the outer face 202 is rectangular in shape so as to form the triangular prism shaped body 170 when the edges of the plates 184, 186, 188 are disposed adjacent to one another. Adjacent edges of corresponding plates are spaced apart from one another to define corresponding open gaps 178, 180, 182.

The heat sink 168 defines multiple cooling passages for a flow of air to efficiently dissipate heat from LEDs 204. In particular, each one of the base plates 184, 186, 188 has an inner surface 206 and a plurality of fins 208 extending therefrom. The fins 208 extend laterally inward therefrom along a width of the heat sink 168. Thus, the fins 208 extend in a radially inward direction with respect to adjacent corresponding portions of the reflector body 116 that concentrically surrounds the heat sink 168.

The fins 208 extend from a bottom portion 210 of each one of the base plates 184, 186, 188 to a top portion 212 of the corresponding base plates 184, 186, 188. In this example, the fins 208 are sinusoidal fins having one or more undulating surface areas that provide a larger surface area exposed to a cooling flow of air. The fins 208 have a peak profile decreasing from a middle portion 214 of the corresponding base plate laterally outward to the opposing edges 198, 200, thus providing a triangular fin profile as shown in an end view of the heat sink 168. In one example, each one of the base plates 184, 186, 188 has a predetermined width, and the height profile includes a maximum height, such that a ratio of the width to the maximum height is at least 3:1. However, it will be appreciated that the width and the maximum height can be greater or less than this ratio. The subject invention optimizes the transfer of heat from the LED boards 228, 230, 232 through the base plates 184, 186, 188 and into the fins 208. If the fins 208 on the middle portions 214 of the base plates 184, 186, 188 were longer, this would cause the LEDs 204 to be closer to the reflector body 116, and then less light may be output.

Figure 7A:
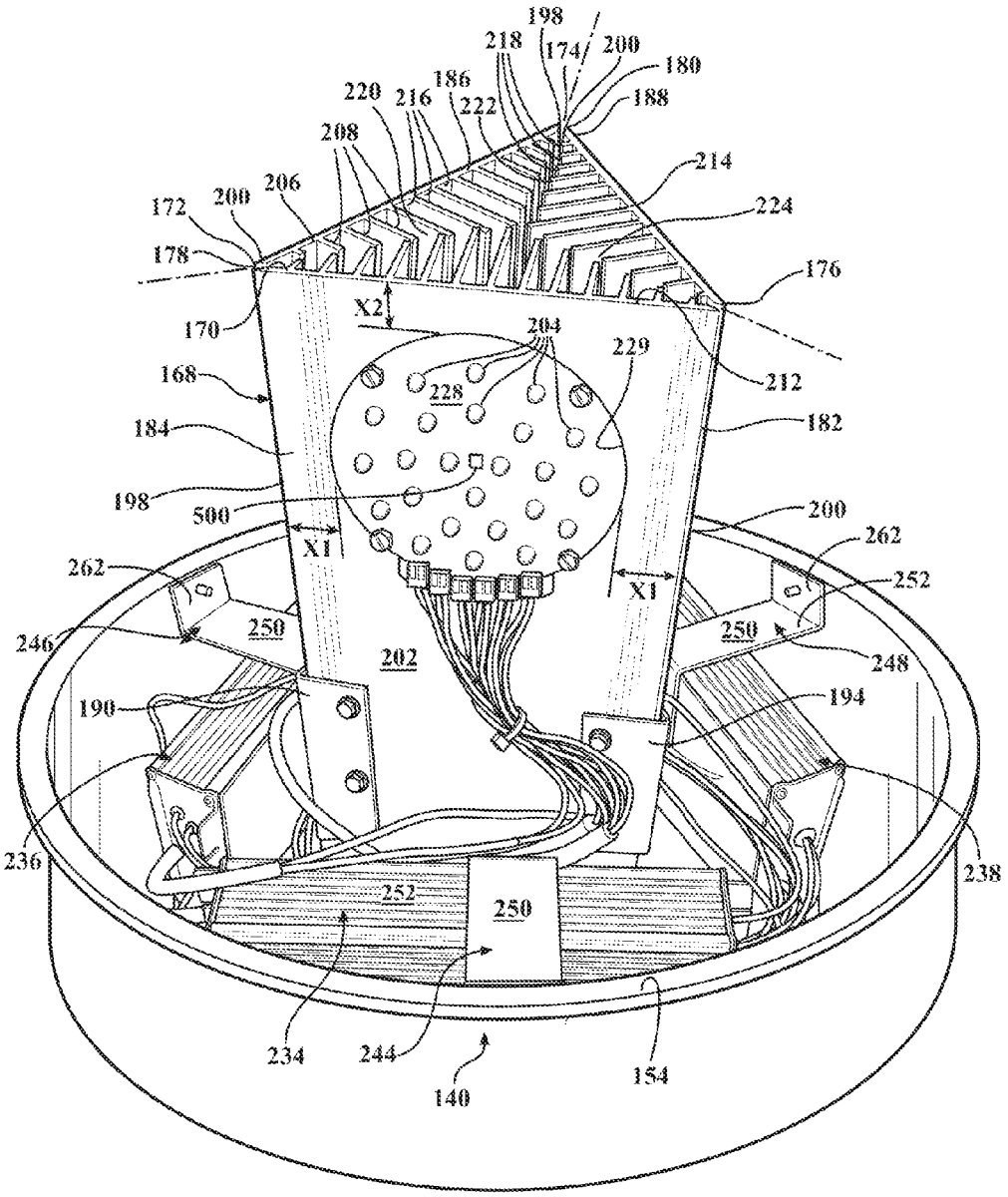
FIG. 7A is a perspective view of the LED system.
Figure 7B:
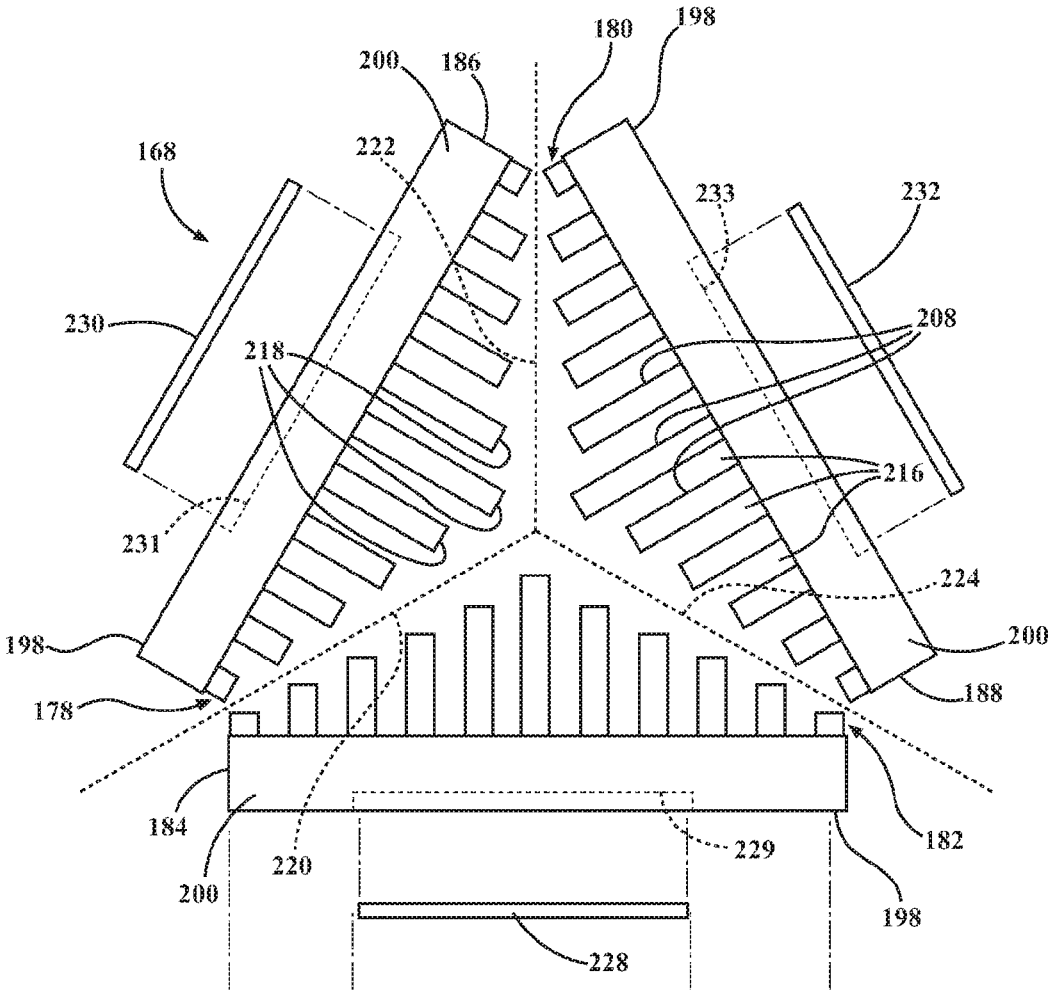
FIG. 7B is a top plan schematic view of the heat sink illustrating three LED boards exploded radially outward from a corresponding one of three recesses of the heat sink.

As best shown in FIG. 7B, the fins 208 are spaced apart from one another so as to define a plurality of fin spacings 216 between adjacent fins 208. Additionally, the fins 208 on base plates 184, 186, 188 have a plurality of ends 218 coordinating with one another to define three cross slots 220, 222, 224 in fluid communication between the fin spacings 216 and the open gaps 178, 180, 182, such that heat is transferred from the fins 208 to air within the fin spacings 216 and the heated air travels from the fin spacings 216, through the cross slots 220, 222, 224 and exits the heat sink 168 through the open gaps 178, 180, 182.

Air within the fin spacings 216 may primarily flow in a longitudinal direction within the fin spacings 216 along the entire height of the heat sink 168, from the bottom portion 210 through the top portion 212. It is contemplated that the heat sink 168 can have one or more non-sinusoidal fins 208 that extend from other portions of the corresponding base plates 184, 186, 188 with various height profiles. Thus, the fins 208 can define more or fewer fin spacings 216, cross slots 220, 222, 224 and open gaps 178, 180, 182 arranged in other linear directions or in non-linear directions, so as to provide various suitable configurations of cooling passages.

Referring back to FIG. 6B, the LED system further includes a plurality of LEDs 204 attached to the outer face 202 of a corresponding one of the three base plates 184, 186, 188. As one example, the LEDs 204 are arranged on the middle portion 214 of each base plate 184, 186, 188 and are spaced apart from the opposing edges 198, 200, by a distance X1, such that heat produced by the LEDs 204 can be more efficiently transferred to the tallest fins 208 and efficiently dissipated into the fin spacings 216 between those fins 208. As one example, the LEDs 204 are spaced apart from the opposing edges 198, 200 by at least one half of an inch.

Moreover, in this example, the LEDs 204 are attached to the top portion 212 of the heat sink 168, and the bottom portion 210 of the heat sink 168 that is adjacent to the reflector body 116 does not include any LEDs. Thus, the LED system 114 is configured to emit light laterally toward a portion of the reflector body 116 that is configured to reflect the light to at least one other portion of the reflector body 116 before the light is emitted from the lighting assembly 100 in a scattered and uniform distribution. Said differently, the LEDs 204 direct light in a horizontal direction which is then reflected out of the lighting assembly 100. In this manner, the subject invention can direct the light that is emitted to desired locations if needed. Further, even though the LEDs 204 are located at the top portion 212, the fins 208 extend the entire length to ensure sufficient dissipation of the heat. It is to be appreciated that the fins 208 may extend less then the entire length so long as sufficient heat is dissipated to maintain the temperature at a desired point.

The LEDs 204 in one form may be provided as three 60 Volt class 2, six-channel LED boards 228, 230, 232, and each LED board 228, 230, 232 can include 20 LEDs 204. However, the LED system 114 can have any number of LEDs 204 provided by any suitable boards or other electrical systems. For example, a single channel board may be used with 24 LEDs 204 or a six-channel board could be used with 18 LEDs 204. These LED boards 228, 230, 232 may be modular to the extent that they are releasably fastened to the heat sink 168, and can thus be removed for repair or replacement. As one example, one or more LED boards 228, 230, 232 may be attached to the heat sink 168 by resilient clip fasteners or an adhesive. Of course, the LED boards 228, 230, 232 can be attached to the heat sink 168 by any suitable fastening method.

Referring to FIG. 7A, the base plates 184, 186, 188 may define recesses 229, 231, 233 that the LED boards 228, 230, 232 can be received in. In particular, each one of the LED boards 228, 230, 232 can be spaced apart from each of the opposing edges 198, 200 by the distance X1, which is less than one inch and preferably one half of an inch and further spaced apart from the top portion 212 by a distance X2, which is less than two inches, preferably from one to two inches, and more preferably one inch. The spacing of the LED boards 228, 230, 232 ensures adequate surface area of the heat sink 168 adjacent to the LED boards 228, 230, 232 to transfer heat and maintain a desired working temperature. The LED boards 228, 230, 232 include a temperature sensor area 500, or thermal resistance junction or Tc, that is the temperature measuring point of the LED boards 228, 230, 232. It has been determined that the length of the base plate should be about twelve inches and preferably from eight to twelve inches to ensure adequate surface for heat transfer. However, the length of the base plate can be greater or less than this range.

Figure 8:
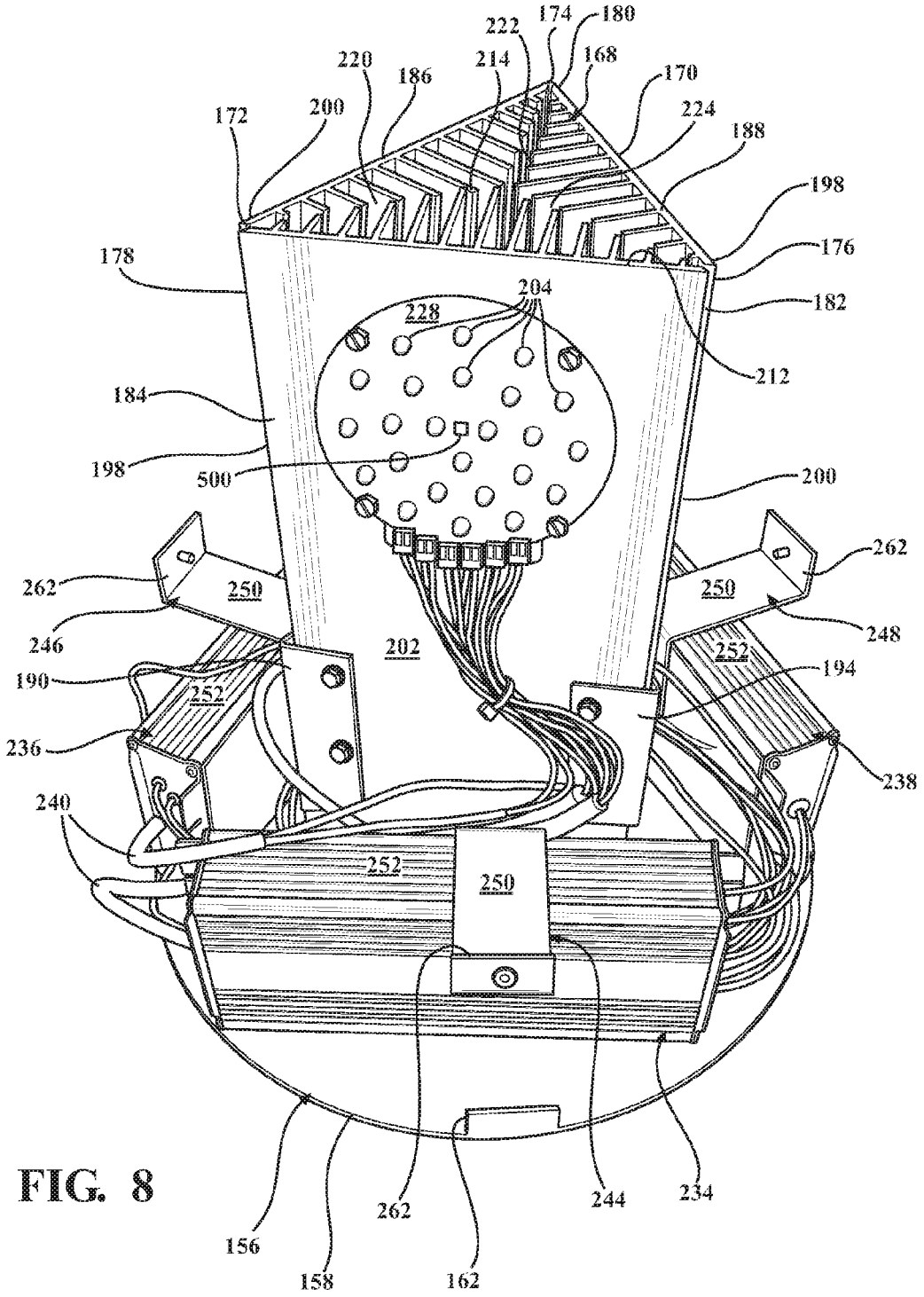
FIG. 8 is a perspective view of the LED system of FIG. 7 with a LED housing removed to better illustrate the heat sink and the LED drivers attached to the mounting plate.

Referring to FIGS. 7B and 8, the LED system 114 further includes one or more LED drivers 234, 236, 238 configured to provide power to the LEDs 204. In this example, the LED system 114 includes three LED drivers 234, 236, 238, which are configured to provide power to a corresponding one of the three LED boards 228, 230, 232. Each one of the LED drivers 234, 236, 238 is electrically coupled to a power cable 240. The power cable 240 is coupled to an electric power source 242 (FIG. 1) for supplying electricity to the LED system 114. The electric power source 242 can be a standard electrical outlet, receptacle, or plug. However, any appropriate electric power source 242 may be utilized. In some embodiments, the lighting assembly 100 may also be directly wired to the power source 242, generally known in the art as hard wired, without deviating from the scope of the present invention. Additionally, it should be appreciated that alternative types of LED drivers, power supplies or AC/DC converters will be required based on the type of light source chosen and will not deviate from the subject invention.

Figure 9:
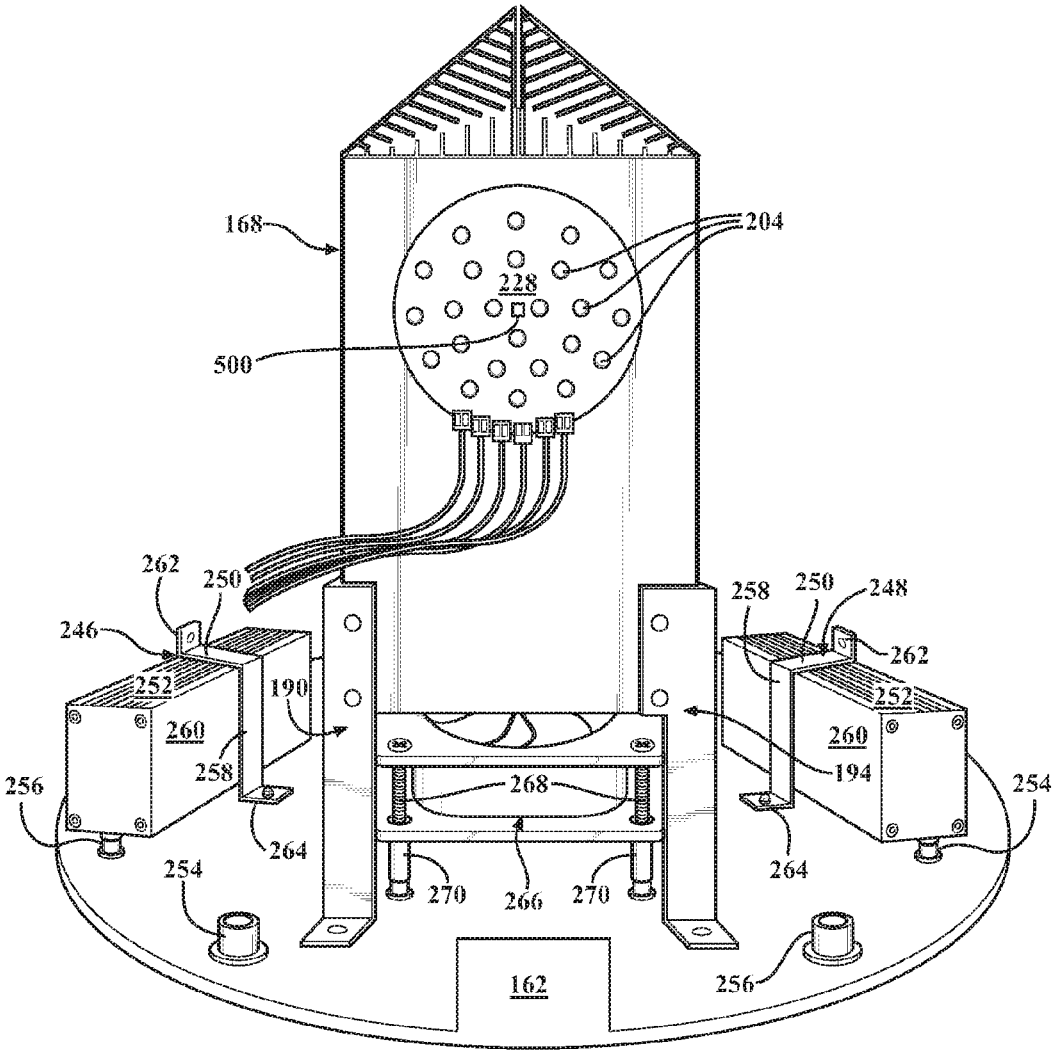
FIG. 9 is an enlarged view of the LED system of FIG. 8, with a proximal one of the LED drivers removed to show the fan disposed under the heat sink.

The LED system 114 can further include retainers configured to attach one or more LED drivers 234, 236, 238 to the mounting plate 156. As shown in FIG. 6A, the LED system 114 includes three retainers 244, 246, 248 for attaching a corresponding one of the LED drivers 234, 236, 238 to the mounting plate 156. Each one of the retainers 244, 246, 248 can be a bracket or formed strip of metal having multiple sections. As best shown in FIG. 9, one section of the bracket can be a detent segment 250 configured to contact an upper surface 252 of the corresponding LED driver 234, 236, 238 and hold the same on one or more spacers 254, 256 attached to the mounting plate 156. These spacers 254, 256 may be configured to space apart a bottom surface of the corresponding LED driver 234, 236, 238 from the mounting plate 156, thus providing a flow path between the same to dissipate heat from the LED drivers 234, 236, 238, as well as from the heat sink 168.

Additionally, each bracket 190, 192, 194 can further include a spacing segment 258 that extends perpendicularly from the detent segment 250 along an inboard surface 260 of the corresponding LED driver 234, 236, 238. The detent segment 250 may be configured to hold the corresponding LED driver 234, 236, 238 a minimum distance apart from the flow paths defined by the center hole 122 and apertures 146. Thus, the spacing segment 258 can prevent the corresponding LED driver 234, 236, 238 from obstructing the flow of air through the heat sink 168 and further prevent the LED driver 234, 236, 238 from receiving excessive heat from the heat sink 168 and the LEDs 204. Each bracket 190, 192, 194 can further include a pair of tabs 262, 264 configured to be attached to a respective one of the LED cap 140 and the mounting plate 156 by threaded fasteners. Thus, the bracket 190, 192, 194 can be removed to permit the repair or replacement of a damaged LED driver 234, 236, 238. It is contemplated that the retainer 244, 246, 248 can have other suitable features and be attached to the LED system 114 by any suitable fastening method, such as a U-shaped resilient clip. Furthermore, other examples of the LED system 114 may not include the retainer 244, 246, 248, particularly an LED system 114 that does not include an LED driver 234, 236, 238.

Referring back to FIG. 6B, the LED system 114 further includes a cooling device 266 disposed adjacent to the bottom portion 210 of the heat sink 168. The cooling device 266 may include a fan system, a heat exchanging thermal compound, a liquid cooling apparatus, a heat pipe, and the like. The cooling device 266 is configured to remove heat from the heat sink 168 from the bottom portion 210 through the top portion 212 of the heat sink. In particular, in one embodiment, the fan 266 is attached to the mounting plate 156 by a series of threaded fasteners 268 and corresponding spacers 270, such that the fan 266 has an axis of blade rotation that is collinear with the central axis C of the lighting assembly 100. The spacers 270 set a predetermined distance between the top of the fan 266 and the bottom of the heat sink 168. The predetermined distance is preferably from 0.5-2 inches and more preferably 0.5-1.5 inches. The most preferred is for the predetermined distance to be 0.5-1 inches. When the predetermined distance is too large or too small, the amount of heat transfer is inadequate. In another embodiment, the heat pipe can engage the heat sink and transfer heat through the heat pipe and into the surrounding air.

Referring to now to FIG. 9, the fan 266 is shown spaced apart from the mounting plate 156, such that the fan can more efficiently draw air radially inward through the vents 152 of the cap 140, thus increasing the amount of air drawn into the LED system and cooling the LED drivers 234, 236, 238 and the heat sink 168. The fan 266 is releasably attached to the mounting plate 156 by threaded fasteners 268, thus permitting access or removal of the fan to easily repair or replace the same. In this example, the fan 266 is electrically coupled to one or more of the LED drivers 234, 236, 238, which are configured to provide power to the fan 266. It is to be appreciated that the fan 266 may be operated in either direction to draw or push air through the lighting assembly 100. For example, it has been found to be particularly useful to operate the fan 266 in reverse mode when the lighting assembly 100 is in a direct mount application such that air is pulled through the lighting assembly 100, which aids in keeping the assembly free of dust and debris.

Figure 10:
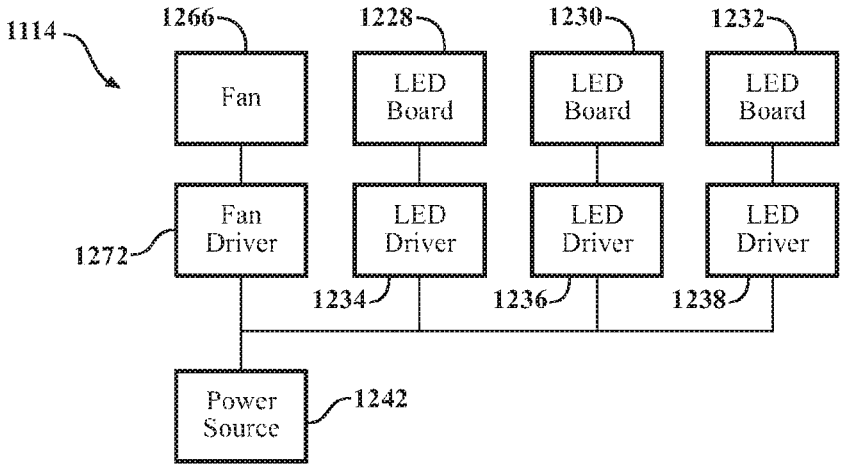
FIG. 10 is a schematic diagram of another exemplary LED system, which is similar to the LED system of FIGS. 6A and 6B and further includes a fan driver configured to provide power to the fan.

FIG. 10 is a schematic diagram of a portion of another exemplary LED system 1114, which is substantially similar to the LED system 114 of FIGS. 6A and 6B, and includes many of the same components. Some of these components are illustrated in FIG. 10 and identified by corresponding reference numerals in the 1100 to 1270 series, including the power source 1242, and LED boards 1228, 1230, and 1232. However, in contrast to the LED system 114 of FIGS. 6A and 6B, the LED system 1114 in this form can further include a separate fan driver 1272 or other power supply electrically coupled to the fan 1266 to provide power to the same, without any of the LED drivers 1234, 1236, 1238 being coupled to the fan 1266.

Figure 11:
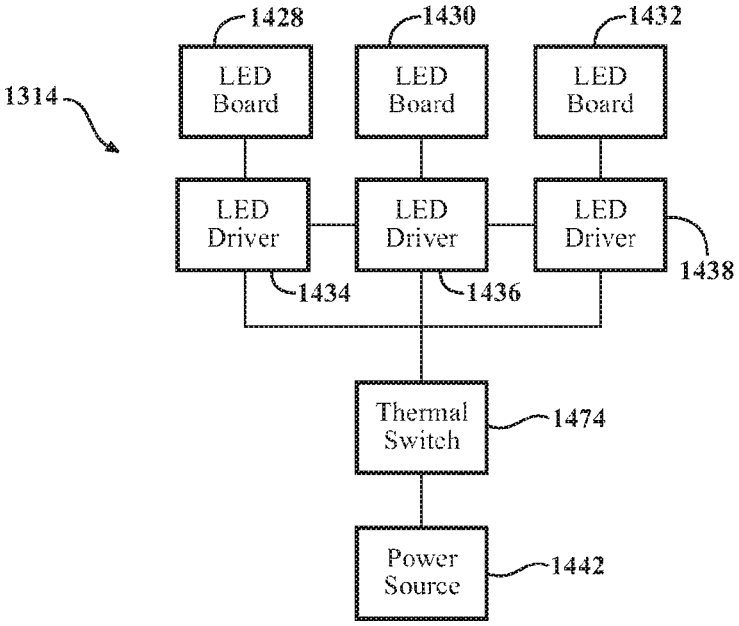
FIG. 11 is a schematic diagram of still another exemplary LED system, which is similar to the LED system of FIGS. 6A and 6B and further includes a thermal switch configured to provide power to the LEDs.

FIG. 11 is a schematic diagram of a portion of still another exemplary LED system 1314, which is substantially similar to the LED system 114 of FIGS. 6A and 6B, and has many of the same components. A few of these components are illustrated in FIG. 11 and identified by corresponding reference numerals in the 1300 to 1470 series. However, as compared to the LED system 114 of FIGS. 6A and 6B, the LED system 1314 in this example can further include one or more thermal controllers or switches 1474 in connection between the LED drivers 1434, 1436, 1438 and the power source 1442. These thermal switches 1474 can be configured to open when the temperature of the heat sink or thermal switch is higher than a predetermined temperature threshold, thus stopping the supply of power to the LED boards 1428, 1430, 1432 and decreasing any potential wear or damage to the components as caused by overheating. The predetermined temperature threshold can be measured with the Tc 500 of the LED boards 1428, 1430, 1432 or internally within the system. Of course, other suitable devices, controllers and sensors can be used to turn off the LEDs when they generate heat above a predetermined threshold.

Figure 12:
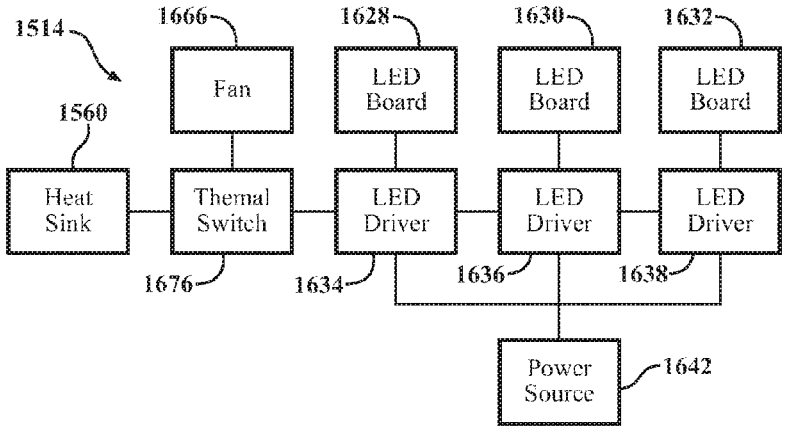
FIG. 12 is a schematic diagram of yet another exemplary LED system, which is similar to the LED system of FIGS. 6A and 6B and further includes a thermal switch configured to provide power to the fan when the temperatures of the heat sink and switch exceed a predetermined threshold.

FIG. 12 is a schematic diagram of a portion of yet another exemplary LED system 1514, which is substantially similar to the LED system 114 of FIGS. 6A and 6B, and has many of the same components. Some of these components are illustrated in FIG. 12 and identified by corresponding reference numerals in the 1500 to 1670 series. However, in contrast to the LED system 114 of FIGS. 6A and 6B, the LED system 1514 can further include one or more thermal controllers or switches 1676 in connection between the fan 1666 and the corresponding LED driver 1634, 1636, 1638, (connected to power source 1642) and each thermal switch 1676 is configured to close when the temperature of the heat sink 1560, the LED boards 1628, 1630, 1632, or thermal switch 1676 is at least a predetermined temperature threshold, such as 70 degrees Celsius. In this manner, the fan can start and stop based on temperature.

Figure 13:
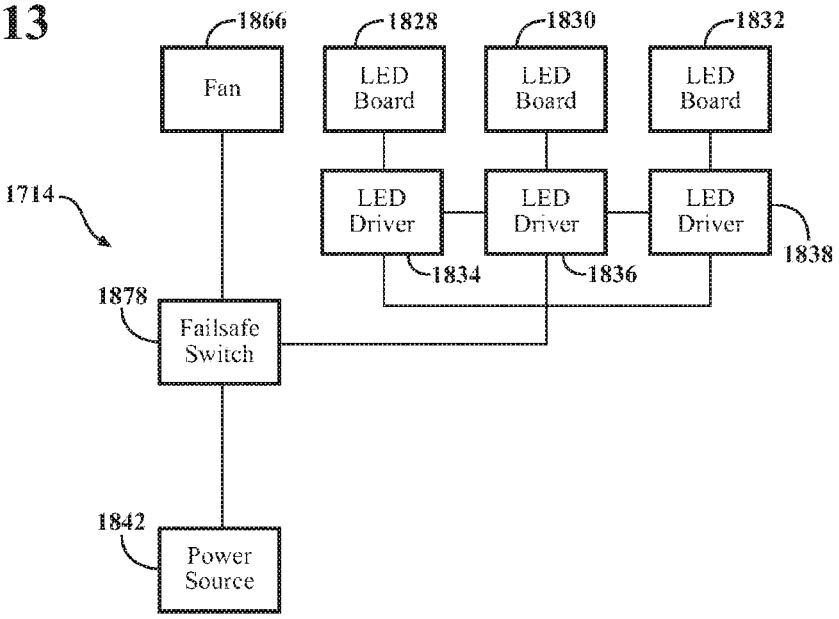
FIG. 13 is a schematic diagram of another exemplary LED system that is similar to the LED system of FIGS. 6A and 6B and further includes a failsafe switch configured to stop providing power to the LEDs when the fan is not operating.

Referring to FIG. 13, yet another example of an LED system 1714 may be substantially similar to the LED system 114 shown in FIGS. 6A and 6B and have the same components, with a portion of these components illustrated in FIG. 13 and being identified in corresponding reference numerals in the 1700 to 1870 series. However, this exemplary LED system 1714 can include one or more failsafe controllers or switches 1878 (connected to power source 1842) in connection between the LED boards 1828, 1830, 1832 and the LED drivers 1834, 1836, 1838. These switches 1878 are configured to turn off the LEDs when the fan 1866 is not operating.

Figure 14:
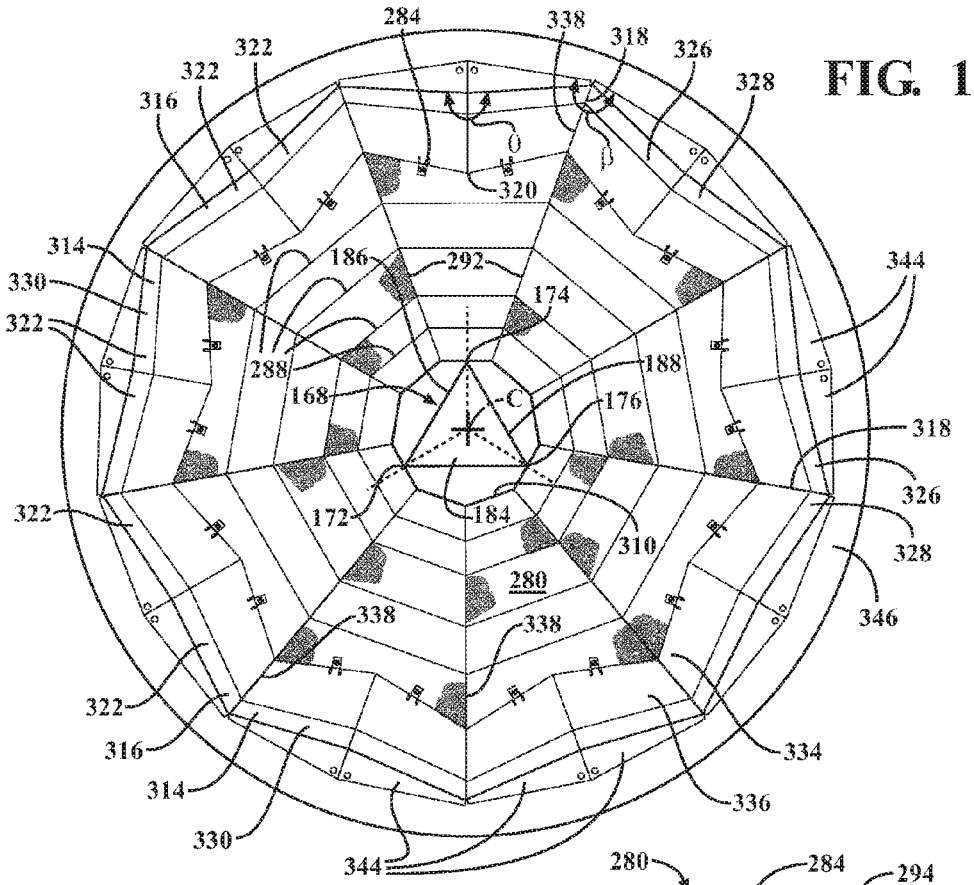
FIG. 14 is a top plan view of the reflector body and the heat sink, showing the reflector body having first reflectors and second reflectors that are configured to prevent the emission of yellow light from the lighting assembly.

Referring to FIG. 14, the reflector body 116 includes a first array of reflectors 280 disposed about the central axis C and collectively forming a dome-shaped configuration. Each one of the first array of reflectors 280 defines a lower end 282, an opposing upper end 284 and a plurality of planar surfaces 286 defined between the lower end 282 and the upper end 284. The planar surfaces 286 are separated from one another by discrete horizontal bends 288, with the planar surfaces 286 collectively forming an arcuate configuration 290 between the lower end 282 and the upper end 284, and adjacent ones of the first array of reflectors 280 are separated by a corresponding vertical edge or crease 292 therebetween. Each one of the creases 292 is offset from a lateral axis of each one of the corners 172, 174, 176, with each lateral axis extending radially outward from a center of the heat sink 168 and through the corners 172, 174, 176 of the heat sink 168. One non-limiting exemplary benefit of this arrangement is that any yellow light emitted by the LEDs 204 is not reflected out of the lighting assembly 100. The lower end 282 of the first reflectors 280 correspond with one another to define a center hole 310. The center hole 310 is provided for allowing a portion of the LED system 114 to pass therethrough and into the reflector body 116.

The reflector body 116 further includes a second array of reflectors 312 disposed about the central axis C. Each one of the second array of reflectors 312 includes a planar left face 314 and a planar right face 316 separated by a vertical bend 318. The vertical bend 318 of one or more of the second array of reflectors 312 intersects the lateral axis of one of the corners 172, 174, 176, which extends radially outward from a center of the heat sink 168 and through the corresponding corner 172, 174, 176 of the heat sink 168.

Figure 15:
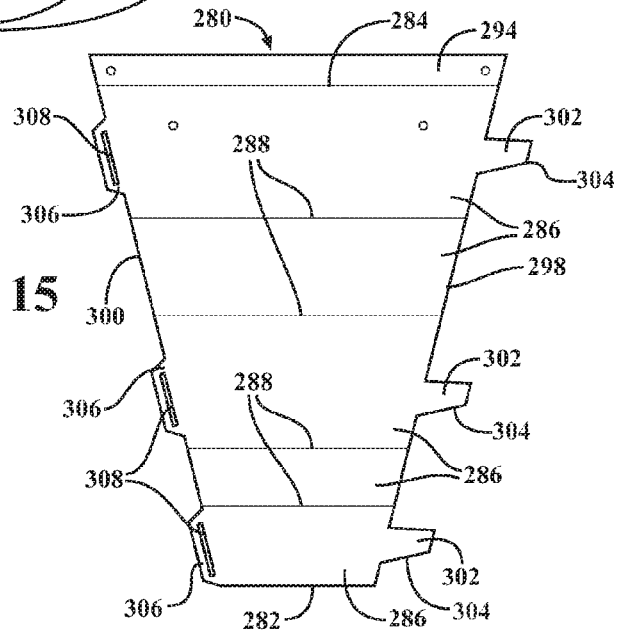
FIG. 15 is a plan view of one of the first reflectors of FIG. 14.

FIG. 15 shows a plan view of one of the first reflectors 280 in a planar view prior to being formed and shaped. A first flange 294 may extend from the upper end 284 for attaching to the lower ring 296 and securing the first reflectors 280 in a first array to one another.

Figure 16:
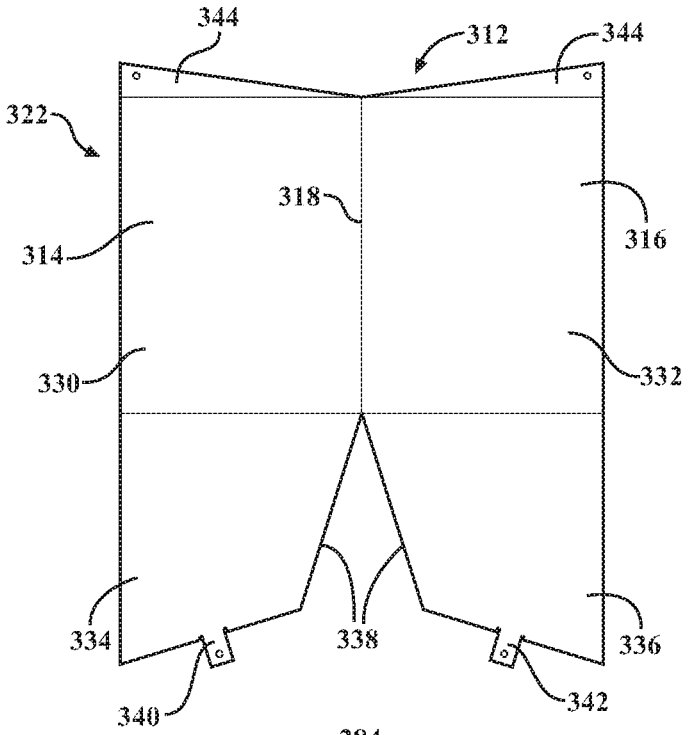
FIG. 16 is a plan view of one of the second reflectors of FIG. 14.

FIG. 16 illustrates a plan view of one of the second reflectors 312 prior to be formed and shaped.

Figure 17:
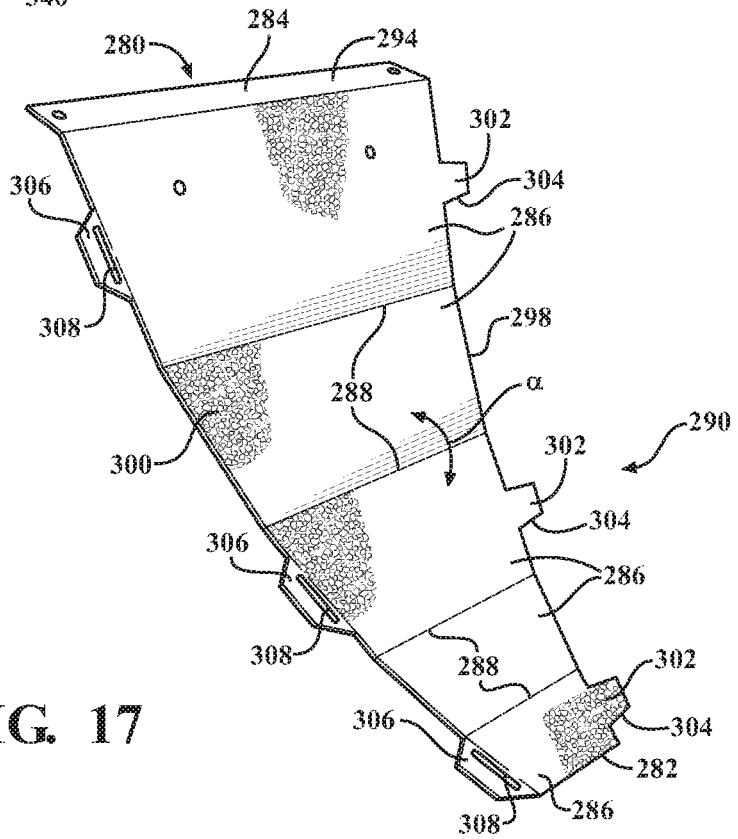
FIG. 17 is a perspective view of one of the first reflectors of FIG. 14.

FIG. 17 illustrates a perspective view of the first reflector 280 of FIG. 15 after being initially bent into a shape to couple with the second reflector 312.

More specifically, as shown in FIG. 17, the first reflector 280 includes a first side 298 and a second side 300. A plurality of first attachment elements 302 may extend from the first side 298. The first attachment elements 302 are further defined as tabs 304. A plurality of second attachment elements 306 may extend from the second side 300 and define a slot 308. Each slot 308 is adapted to accept one of the tabs 304 extending from the next adjacent first reflector 280 for securing the first reflectors 280. It will be appreciated that other methods of attaching the first reflectors 280 together may be employed without deviating from the subject invention.

FIG. 18 illustrates a perspective view of the second reflector 312 of FIG. 16 after being initially formed, but prior to being coupled to the first reflector 280 of FIG. 17.

Figure 19:
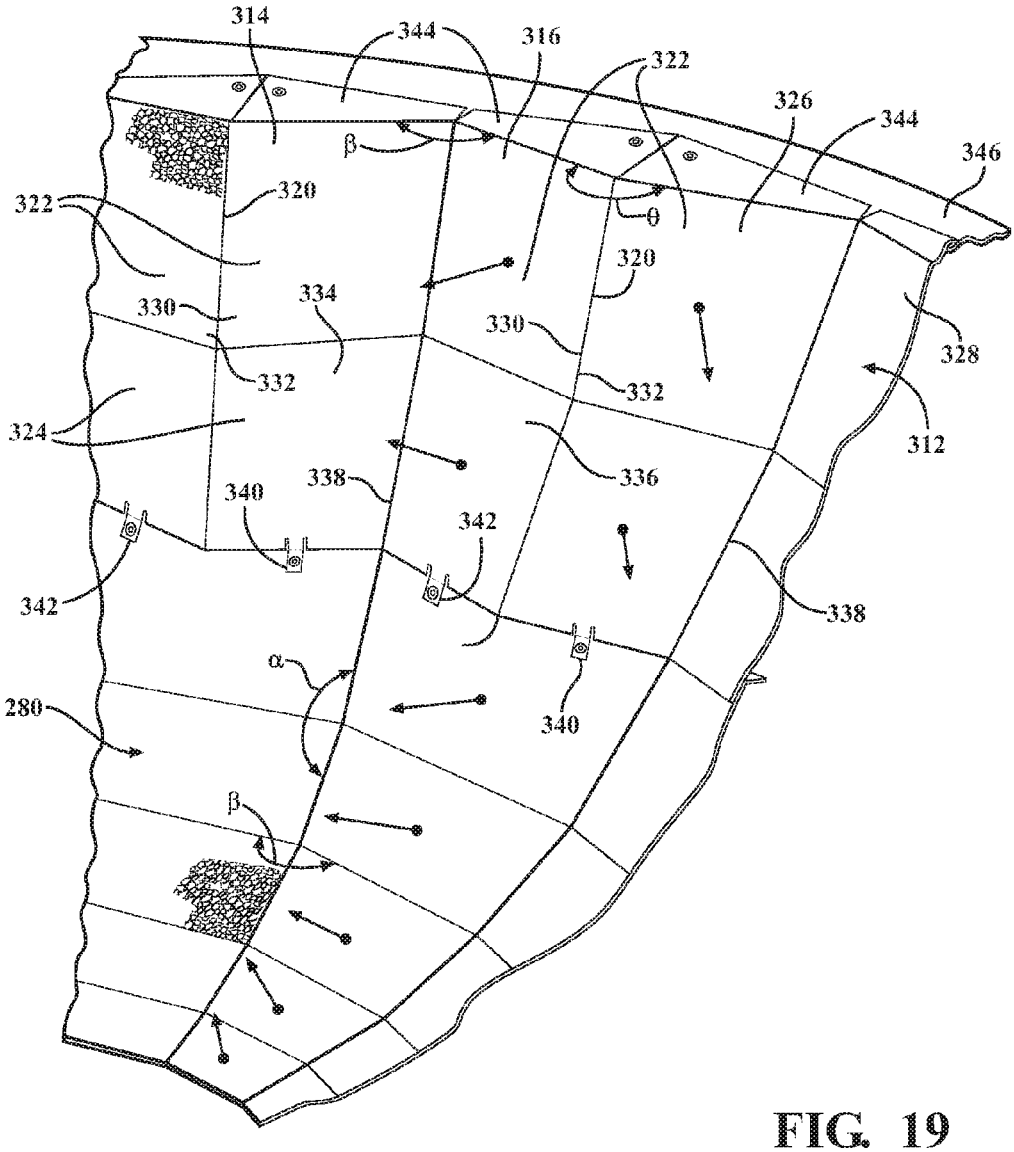
FIG. 19 is a perspective of a portion of the reflector body of FIG. 14.

As shown in FIGS. 19 and 20, the first reflectors 280 are disposed adjacent to one another in circumferential direction so as to provide the first array. Each one of the first reflectors 280 are in an obtuse angular relationship with the next adjacent first reflector 280. As a result of the obtuse angular relationships, the first reflectors 280 collectively form a dome-shaped configuration. For illustrative purposes only, this obtuse angular relationship is illustrated as β. Typically β is of from about 110° to about 170°, more typically from about 120° to about 150°.

Each of the planar surfaces 286 are in an obtuse angular relationship with each of the next adjacent planar surfaces 286. For illustrative purposes only, this obtuse angular relationship is illustrated as a in FIG. 19. It will be appreciated that the obtuse angular relationship α between each of the planar surfaces 286 may vary along the first reflector 280. Said differently, each of the planar surfaces 286 are at different obtuse angles relative to one another. The obtuse angles between the planar surfaces 286 progressively get steeper moving from the lower end 282 toward the upper end 284 along each of the first reflectors 280, such that an arcuate configuration 290 is formed, as best shown in FIG. 17. Additionally, each of the planar surfaces 286 increase in size, moving from the lower end 282 toward the upper end 284. As a result of the obtuse angular relationship between adjacent planar surfaces 286, the planar surfaces 286 collectively form an arcuate configuration 290 between the lower end 282 and the upper end 284.

Referring again to FIG. 19, the second reflectors 312 are coupled to the first reflectors 280, forming the dome-shaped configuration. The left face 314 and the right face 316 define a reflex angle θ therebetween. In one embodiment, θ is greater than 180°. More specifically, θ is defined in a range between 181° and 270°. Alternatively, θ is defined in a range between 181° to 220°.

The reflex angle θ terminates in a vertex 320 forming a triangular protrusion extending toward the central axis C. The vertex 320 is centrally disposed on the planar surface of the first reflectors 280 nearest each of the second reflectors 312. The left face 314 and the right face 316 each include an upper segment 322 and a lower segment 324 and define an obtuse angular relationship between the upper segment 322 and the lower segment 324 of each of the left and right faces 314, 316, such that the upper segment 322 is at a steeper incline than the lower segment 324. For illustrative purposes only, this obtuse angular relationship is illustrated as γ in FIG. 20. Additionally, two adjacent second reflectors 312 define an obtuse angular relationship, illustrated as β as described below.

Each of the second reflectors 312 are formed by a pair of next adjacent upper panels 326, 328, which define a primary side 330 and a secondary side 332. The primary side 330 forms the right face 316 of one of the second reflectors 312 and the secondary side 332 forms the left face 314 of the next adjacent second reflectors 312. The upper panels 326, 328 include the upper segment 322 of the second reflectors 312 described above.

Additionally, the upper panels 326, 328 include a pair of legs 334, 336 extending from the upper segment 322 and define a slit 338 therebetween for allowing the upper panels 326, 328 to bend, forming the second reflectors 312. The legs 334, 336 form the lower segment 324 of the second reflectors 312. The legs 334, 336 may include projections 340, 342 extending therefrom for fastening to the first reflectors 280.

Each one of the primary side 330 and the secondary side 332 of the upper segment 322 includes a second flange 344 extending therefrom. Each second flange 344 attaches to an upper ring 346 for securing the upper panels 326, 328 of the second reflectors 312. In one embodiment, the slit 338 is aligned with the second side 300 of one of the first reflectors 280 and the first side 298 of the next adjacent first reflectors 280, such that one of the legs 334, 336 of the upper panels 326, 328 is coupled to one of the first reflectors 280 and the other one of the legs 334, 336 is coupled to the next adjacent first reflectors 280.

In one example, the first reflectors 280 and the second reflectors 312 are fabricated from MICRO-4 aluminum, manufactured by ALANOD. Alternatively, the first reflectors 280 and the second reflectors 312 may be formed of other suitable materials.

A variety of finishing treatments may be applied to the surface of the first reflectors 280 and the second reflectors 312. Varying sized dimples may be applied to the surface to achieve the desired light output of the lighting assembly 100. This dimpling may be referred to as hammer-tone finishing (not shown). For instance, the dimpling has a diameter of ½ inch or less. In another embodiment, the dimpling has a diameter of ⅜ inch or less, or even ¼ inch or less. Alternatively, the surface can be left smooth, resulting in a mirror-like finish. The first reflectors 280 and the second reflectors 312 may have similar or different types of finishing treatments depending on the application of the lighting assembly 100. It will be appreciated that any other appropriate finishing treatments may be applied to the first reflectors 280 and the second reflectors 312.

In one example, the first reflectors 280 can be formed or cast as a single integral unit, as compared to an array of separate reflectors, so as to efficiently absorb heat from the LED assemblies 100. In another example, the first reflectors 280 and second reflectors 312 can be formed or cast as a single integral unit, instead of two arrays of separate reflectors that are assembled together.

Other examples of the lighting assembly 100 may further include a dimming apparatus (not shown) coupled to the LED system 114 for allowing the LED system 114 to be dimmed. The dimming apparatus is well known to those in the lighting arts and may be incorporated into the lighting assembly 100 for dimming the light output from the LED system 114 within the lighting assembly 100. Each LED system 114 may be dimmed of from about 100% light output to about 10% light output, more typically from about 100% light output to about 25% light output, and most typically from about 100% light output to about 50% light output. Dimming is desirable because it will help extend the life of each LED system 114 as well as save energy and costs associated therewith. Additionally, dimming each LED system 114 allows the lighting assembly 100 to remain on in a low output setting for extended periods of time and only consume a relatively small amount of electricity. Remaining on at the low output setting is advantageous because it allows the lighting assembly 100 to be utilized instantly when it is needed and eliminates extended "warm-up" periods before the lighting assembly 100 is outputting light at a usable level. These "warm-up" periods are a common downfall of lighting assemblies presently available on the market and may take up to ten minutes or more when the lighting assembly is switched to an on setting.

The subject invention also has reduced weight when compared to standard LED assemblies and can achieve a weight reduction of about 50%. Typically, the subject invention is about 33 pounds which permits the lighting assembly to be useful for additional applications that the prior art could not be, such as dome facilities that have fabric type shells. The weight reduction is achieved by the combination of fins 208 and fan 266.

The subject invention is also capable of maintaining a more stable operating temperature due to the fins 208 and the fan 266 as shown and described above. The more stable operating temperature ensures that the LED will achieve the desired life span and light output. Specifically, the LED boards 228, 230, 232 will achieve an operating temperature of less than 100° C., preferably from 65-85° C., and more preferably from 70-80° C., measured at the temperature sensor area 500. When only fins are used, the LED boards 228, 230, 232 reach a temperature of about 130° C. and the life the LEDs is shortened. The combination of the subject invention maintains the operating temperature at or below about 77° C. One additional advantage of the subject invention is that the LED system 114 consumes less power as compared to conventional high intensity discharge (HID) lamps while outputting more light. For example, the subject invention outputs 10% more light while consuming 54 watts less than the similar reflector with a T9 light bulb.

Accordingly, it is to be understood that the above description is intended to be illustrative and not restrictive. Many embodiments and applications other than the examples provided would be apparent upon reading the above description. The scope should be determined, not with reference to the above description, but should instead be determined with reference to the appended claims, along with the full scope of equivalents to which such claims are entitled. It is anticipated and intended that future developments will occur in the technologies discussed herein, and that the disclosed systems and methods will be incorporated into such future embodiments. In sum, it should be understood that the application is capable of modification and variation.

All terms used in the claims are intended to be given their broadest reasonable constructions and their ordinary meanings as understood by those knowledgeable in the technologies described herein unless an explicit indication to the contrary is made herein. In particular, use of the singular articles such as "a," "the," "said," etc. should be read to recite one or more of the indicated elements unless a claim recites an explicit limitation to the contrary.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

What is claimed is:

1. A lighting assembly for illuminating an area, the lighting assembly comprising:

a reflector body surrounding an opening and comprising a first array of reflectors disposed about a central axis and collectively forming a dome-shaped configuration, and each one of the first array of reflectors defines a lower end, an opposing upper end and a plurality of planar surfaces defined between the lower end and the upper end, wherein the plurality of planar surfaces are separated from one another by discrete horizontal bends, with the planar surfaces collectively forming an arcuate configuration between the lower end and the upper end, wherein adjacent ones of the first array of reflectors are separated by a corresponding crease therebetween;

an LED system comprising a heat sink and a plurality of LED boards, the heat sink comprising a plurality of base plates, each one of the base plates comprising a pair of opposing edges extending vertically between a top edge and a bottom edge, an outer face extending between the opposing edges, and an inner face;

wherein the plurality of LED boards are coupled to the outer face of a corresponding one of the base plates, each one of the LED boards comprising a plurality of LEDs and the LED boards being spaced apart from the top edge of a corresponding one of the base plates by at most two inches and spaced less than one inch from the opposing edges;

wherein the heat sink further comprises a plurality of fins extending from the inner face, and the plurality of fins comprises a peak profile decreasing from a middle portion of the corresponding base plate laterally outward to the opposing ends and wherein the plurality of fins extend from the top edge to the bottom edge of the base plate;

each one of the opposing edges of the base plates is disposed adjacent to a corresponding edge of the other base plates defining a plurality gaps for passage of air and the plurality of fins on the base plates have a plurality of ends coordinating with one another to define cross slots fluidly communicating with the plurality of gaps;

wherein each one of the base plates comprises a width extending perpendicularly from one of the opposing edges to the other of the opposing edges, and the peak profile comprises a maximum height extending perpendicularly from the middle portion of the corresponding base plate, wherein a ratio of the width to the maximum height is at least 3:1;

wherein the heat sink has a bottom portion adjacent to the reflector body and a top portion spaced apart from the reflector body, and the plurality of LED boards are coupled to the top portion of the heat sink while the bottom portion does not comprise the plurality of LED boards;

a fan releasably attached to the bottom portion of the heat sink and configured to produce a flow of air through the heat sink from the bottom portion through a top portion of the heat sink; and wherein each one of the corresponding creases is offset from a lateral axis of a plurality of corners of the heat sink, the lateral axis extending radially outward from a center of the heat sink and through the corner of the heat sink.

2. The lighting assembly of claim 1 including a second array of reflectors disposed about the central axis, and each one of the second array of reflectors comprising a left face and a right face separated by a vertical bend.

3. The lighting assembly of claim 1 wherein the vertical bend of at least one of the second array of reflectors intersects the lateral axis of one of the corners of the heat sink.

4. The lighting assembly of claim 1 wherein the LED boards are spaced at least one half of an inch from the opposing edges.

5. The lighting assembly of claim 1 further comprising a housing that defines a cavity, and the LED system further includes a cap that is attached to the housing and has at least a portion of the heat sink disposed therein, the cap includes an aperture and a plurality of vents circumferentially spaced apart from one another and configured to pass a flow of air therethrough, which removes heat from the LED system.

6. The lighting assembly of claim 5 further comprising:

a mounting plate received within the cap, and the mounting plate has a center hole aligned with the aperture of the cap; and a plurality of LED drivers releasably attached to the mounting plate and spaced apart therefrom by a plurality of spacers.

* * * * *